US005574475A

United States Patent [19]

Callahan, Jr. et al.

[11] Patent Number: 5,574,475

[45] Date of Patent: Nov. 12, 1996

[54] SIGNAL DRIVER CIRCUIT FOR LIQUID CRYSTAL DISPLAYS

[75] Inventors: Michael J. Callahan, Jr.; Christopher A. Ludden, both of Austin, Tex.

[73] Assignee: Crystal Semiconductor Corporation, Austin, Tex.

[21] Appl. No.: 138,366

[22] Filed: Oct. 18, 1993

[51] Int. Cl.[6] ..... G09G 3/36

[52] U.S. Cl. ..... 345/100; 345/211

[58] Field of Search ..... 345/100, 99, 98, 345/94, 95, 96, 211, 212, 213; 307/264, 475, 296.1; 323/315

[56] References Cited

U.S. PATENT DOCUMENTS

| | | | |
|---|---|---|---|
| 3,522,420 | 8/1970 | Hartmann et al. | 235/150.52 |
| 3,560,957 | 2/1971 | Miura et al. | 340/347 |
| 4,180,813 | 12/1979 | Yoneda | 340/784 |
| 4,193,669 | 3/1980 | Richardson | 345/48 |
| 4,210,934 | 7/1980 | Kutaragi | 358/241 |
| 4,353,062 | 10/1982 | Lorteije et al. | 340/767 |
| 4,427,978 | 1/1984 | Williams | 340/784 |
| 4,429,305 | 1/1984 | Hosokawa et al. | 340/784 |
| 4,554,539 | 11/1985 | Graves | 340/805 |
| 4,571,584 | 2/1986 | Suzuki | 340/784 |
| 4,685,769 | 8/1987 | Fukuma et al. | 345/100 |
| 4,748,444 | 5/1988 | Arai | 345/94 |
| 5,099,192 | 3/1992 | Thayer et al. | 323/315 |
| 5,196,738 | 3/1993 | Takahara et al. | 307/296.1 |
| 5,198,747 | 3/1993 | Haight | 323/303 |
| 5,237,212 | 8/1993 | Maekawa | 307/264 |
| 5,243,333 | 9/1993 | Shiba et al. | 345/100 |
| 5,276,365 | 1/1994 | Maekawa | 307/475 |

FOREIGN PATENT DOCUMENTS

| | | |
|---|---|---|
| 0071911A2 | 7/1982 | European Pat. Off. . |
| 0391655A2 | 4/1990 | European Pat. Off. . |
| 0478386A2 | 9/1991 | European Pat. Off. . |
| 0488516A2 | 10/1991 | European Pat. Off. . |
| 0515191A2 | 5/1992 | European Pat. Off. . |
| 0526713A2 | 6/1992 | European Pat. Off. . |

OTHER PUBLICATIONS

Bakoglu, "Circuits, Interconnections, and Packaging for VLSI," *Interconnection Capacitance*, Chapter 4, 156–169, 1990.

Heller and Griffin, "Custom and Semi–Custom Design Techniques," *Digest of Technical Papers*, 16–17, 1984.

S. Terazawa and H. Yamaguchi, "Driving Method for TFT/LCD Grayscale," *IBM Technical Disclosure Bulletin*, vol. 33 No. 6B, 384–385, Nov. 1990.

"Development of a Low Voltage Source Driver for Large TFT–LCD System for Computer Applications", *Conference Record of the 1991 International Display Research Conference*, pp.111–114 (Oct. 15, 1991).

International Search Report PCT/US 94/09882 (Jan. 27, 1995).

*Primary Examiner*—Steven Saras

*Attorney, Agent, or Firm*—Arnold, White & Durkee

[57] ABSTRACT

The present invention relates to a signal driver circuit for driving a liquid crystal display panel. The signal driver circuit provides level shifting within the circuit to lower the power consumption of a liquid crystal display module while still providing a wide analog voltage range to the liquid crystal display elements. Furthermore, reference voltages are provided to decoding circuits by using distributed resistors. The decoding circuits utilize a cell layout that allows data to bused into the cell through polysilicon that also operates as the gate of the decode input transistors. The decode input transistors are arranged in strands of abutting transistors which may be connected in series or in parallel. Moreover, the decode cell input transistors may all be of the same conductivity type.

25 Claims, 23 Drawing Sheets

20
21
24
22
25
28
30
D05~D00
D15~D10
D25~D20
EIO2#
6
6
6
HSYNC
DCLK
GND
DIR
VDDA
VDDD
EIO1#
CONTROL LOGIC UNIT
ADDRESS SHIFT REGISTER
D25~D20
D15~D10
D05~D00
INPUT REGISTERS (67X3 CHANNELS @ 6-BITS/CHANNEL)
201X6-BITS
STORAGE REGISTERS (67X3 CHANNELS @ 6-BITS/CHANNEL)
LEVEL SHIFTER
DECORDER/OUTPUT VOLTAGE DRIVERS (201 CHANNELS)
VS1
VS2
VS3
VS4
VS5
VS6
VS196
VS197
VS198
VS199
VS200
VS201
FROM BUFFER AMPLIFIER
V8~V0
9
RESISTIVE STRING
26
14 a, b, c, d, e, f, and hSync are data from Vsupply1 (3.3V).

SIGNAL DRIVER CIRCUIT FOR LIQUID CRYSTAL DISPLAYS

BACKGROUND OF THE INVENTION

This invention relates to a signal driver circuit for a liquid crystal display ("LCD"), and more particularly, to a digital-in/analog-out signal driver circuit for controlling the gray levels of LCD pixels in LCD column driving applications.

Signal driver circuits are commonly employed with liquid crystal displays. The driver circuit typically accepts digital video data as an input and provides an analog voltage output to each particular LCD pixel column. Generally, each column in the LCD must be uniquely addressed by a signal or column driver and given the proper analog voltage in order to achieve the desired transmissivity (i.e., the desired shade of gray or color). Moreover, it is desirable that the output voltage range of a driver circuit be wide to allow for a high pixel contrast ratio.

For color LCDs, each pixel is composed of 3 sub-pixel elements representing the primary colors of red, green and blue. For example, a color VGA panel having a resolution of 640 columns ×480 rows of uniquely addressable pixels will have 3×640 columns, or 1,920 columns. Typically, the signal driver circuit has one driver output for each column. Thus controlling an LCD panel requires a large number of driver outputs that consume considerable circuit area. Since circuitry size impacts the costs of a signal driver, it is desirable to reduce the size of signal drivers.

As LCD panel technology has improved, it has become desirable to render images with more continuous gray scales or to have more unique colors available. The voltage control required from signal drivers has, therefore, become more complex. However, it is also desirable to reduce the cost of a driver circuit by decreasing the physical size of the signal driver and desirable to reduce the amount of power dissipated by the driver circuit. Therefore, it is desirable to have a signal driver which balances the need for more discrete analog voltage levels while consuming less area and dissipating less power.

SUMMARY OF THE INVENTION

The present invention satisfies the above-noted desires by providing a signal driver for a liquid crystal display capable of producing a great number of discrete analog voltage levels, while dissipating less power, and consuming less chip area.

Signal driver area is reduced by use of a unique decoder cell design, and power dissipation is minimized, without sacrificing control over the transmissivity of the LCD, by level shifting the signal driver operating voltage. Thus, an LCD module and signal driver may operate at lower voltages than the required signal driver output voltages.

The decoder cell utilizes data input bus lines that also serve as decoder input transistor gates. These gates may be connected in series and parallel by programming conductors. Further, it is desirable that the decoder input transistors be the same conductivity type.

The signal driver also utilizes a unique distributed voltage resistor divider for supplying various gray scale voltages to the decoder cells. Preferably, the resistor divider includes at least two resistor strings spaced across the signal driver chip. This minimizes the resistance drop from the voltage dividers to the decoder cells and minimizes variations between the signal drivers.

In one embodiment of the present invention, level shifting is incorporated. In order to level shift, a signal driving circuit for driving an LCD panel includes a plurality of data inputs at a first voltage level, a plurality of driver outputs to the LCD panel that may operate at a second voltage which may be higher than the first voltage, and a voltage level shifter within the signal driver circuit for shifting voltage levels. The level shifter may shift voltage levels of data input buffers within the signal driver circuit. Alternatively, the level shifters may be placed so that the output of registers within the signal driver circuit are shifted. In another embodiment, a level shifter is connected to each of the decoder cells within the signal driver.

In yet another embodiment of the present invention, a decoder circuit within an LCD signal driver chip is provided. The decoder circuit may have a plurality of data input lines operating at a first voltage level and a plurality of decoder cells connected to the data input lines. Also included may be a plurality of switches controlled by the decoder cells. The switches are arranged to switch reference voltage lines to outputs of the decoder circuit. The reference voltage lines may operate at a voltage level greater than the first supply voltage level. Level shifting is accomplished by connecting a second supply voltage which is greater than the first supply voltage to at least one node of each decoder cell. It is noted that the present invention also includes a method for level shifting the operating voltage level within an LCD signal driver including the steps of sampling input data from a plurality of inputs, the input data operating at a first voltage level, bussing a digital decode state at the first voltage level into a decoder cell, decoding the digital data and level shifting the voltage level of the decoder output to a second voltage level having a magnitude greater than the first voltage level.

The present invention also contemplates unique routing for a decoder cell used in an LCD driver. In one embodiment, a decoder cell within an LCD driver is used to select one of a plurality of voltages for application to an LCD panel. The cell includes a plurality of data input lines which form a plurality of transistor gates. The data input lines also pass through the cell to provide data input to adjacent cells. The data input lines cross at least one active region of the cell. A switch is operable to apply one of a plurality of voltages to the LCD panel under control of one transistor formed in the active region by at least one of the plurality of transistor gates.

Another embodiment of the present invention includes a programmable decoder cell within an LCD signal driver circuit for selecting a voltage to be applied to an output of the signal driving circuit. The cell includes a plurality of substantially parallel data bus lines which carry a digital number representing a desired output voltage of the signal driver circuit. Furthermore, at least one transistor active area is provided, with the bus lines crossing over the active area. In addition, a plurality of programming conductors cross over the plurality of data bus lines, and are selectively connected to the active area to program the decoder cell. In another embodiment of the present invention, it is noted that an LCD decoder circuit for decoding a unique digital state to select at least one of a plurality of references voltages to be applied to an output of an LCD driver is provided. The decoder circuit includes a plurality of data lines, a plurality of input transistors, a first plurality of the input transistors having a first conductivity type and being connected in series, each gate of the first plurality of transistors being electrically connected to the data lines. The input transistors also include a second plurality of transistors having the same conductivity type as the first plurality of transistors, each gate of the second plurality of transistors being electrically connected to the data lines and being connected in parallel. The decoder cell also includes at least one additional second conductivity type transistor connected to at least one of the plurality of input transistors.

Finally it is noted that according to an embodiment of the present invention, a signal driver circuit for driving an LCD panel is provided which includes at least one reference voltage input, a plurality of decoding cells for selecting voltages for the outputs of the signal driving circuit, a resistor voltage divider, and at least one conductor connected between the resistor voltage divider and at least one of the decoding cells. The resistor voltage driver includes a first resistor series including a plurality of resistors connected in series, and a second resistor series also including a plurality of resistors connected in series. One of the first plurality of resistors is connected in parallel with at least one of the second plurality of resistors to form a parallel connected resistor. The conductor may then be connected to an output of the parallel connected resistors. A plurality of the decoding cells is located between the first resistor series and the second resistor series. In yet another embodiment, a signal driver circuit for providing a plurality of voltage levels to an LCD panel is provided. The signal driver circuit includes a plurality of decoding cells spaced across the circuit and a plurality of resistor voltage dividers adapted to provide voltages to the decoder cells. The plurality of resistor voltage dividers are formed at a plurality of locations within the circuit and at least a portion of the decoder cells are positioned between these locations.

DETAILED DESCRIPTION

Figure 1:
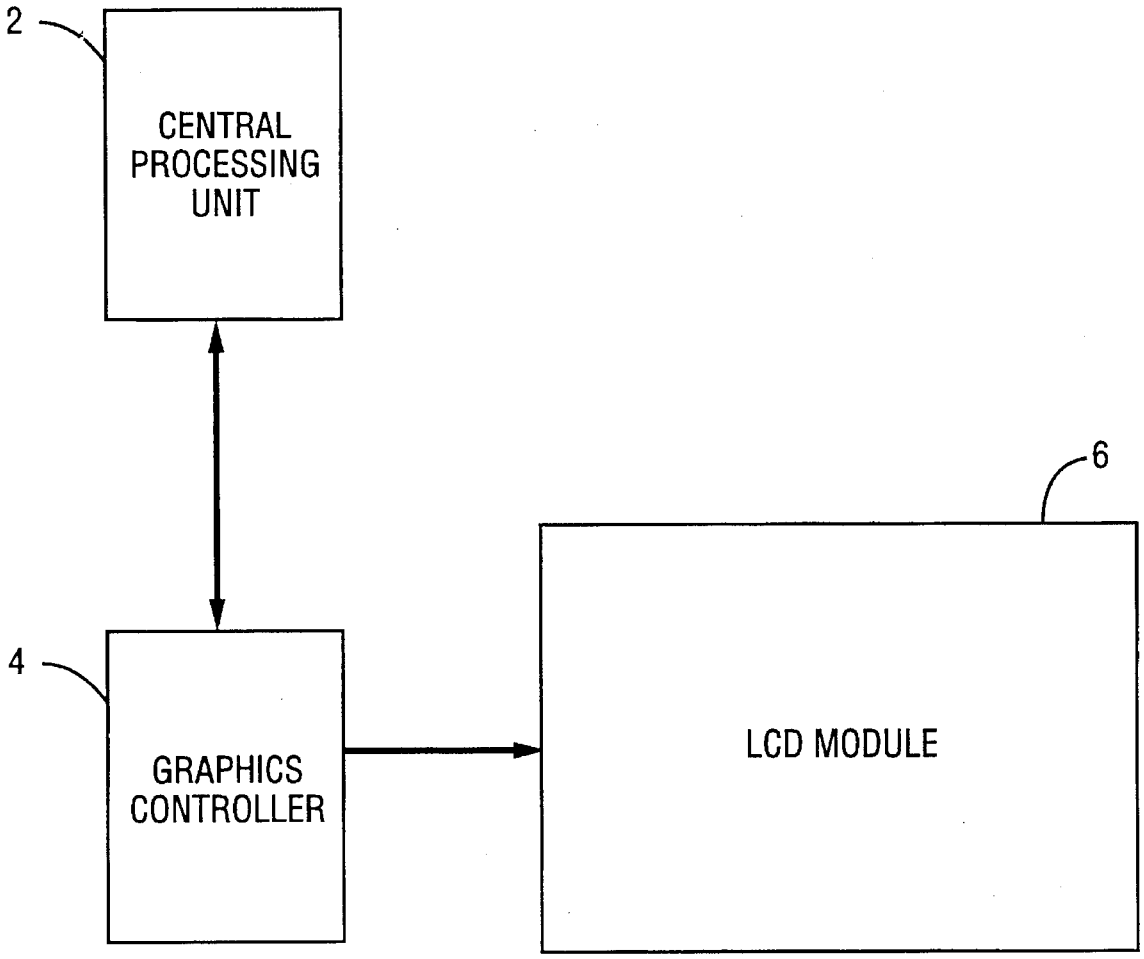
FIG. 1 shows an operating environment for a liquid crystal display module.

FIG. 1 illustrates a typical LCD application. Generally, a central processing unit 2 interacts with a graphics controller 4 which then provides digital data to an LCD module 6 in order to visually display data for a user.

Figure 2:
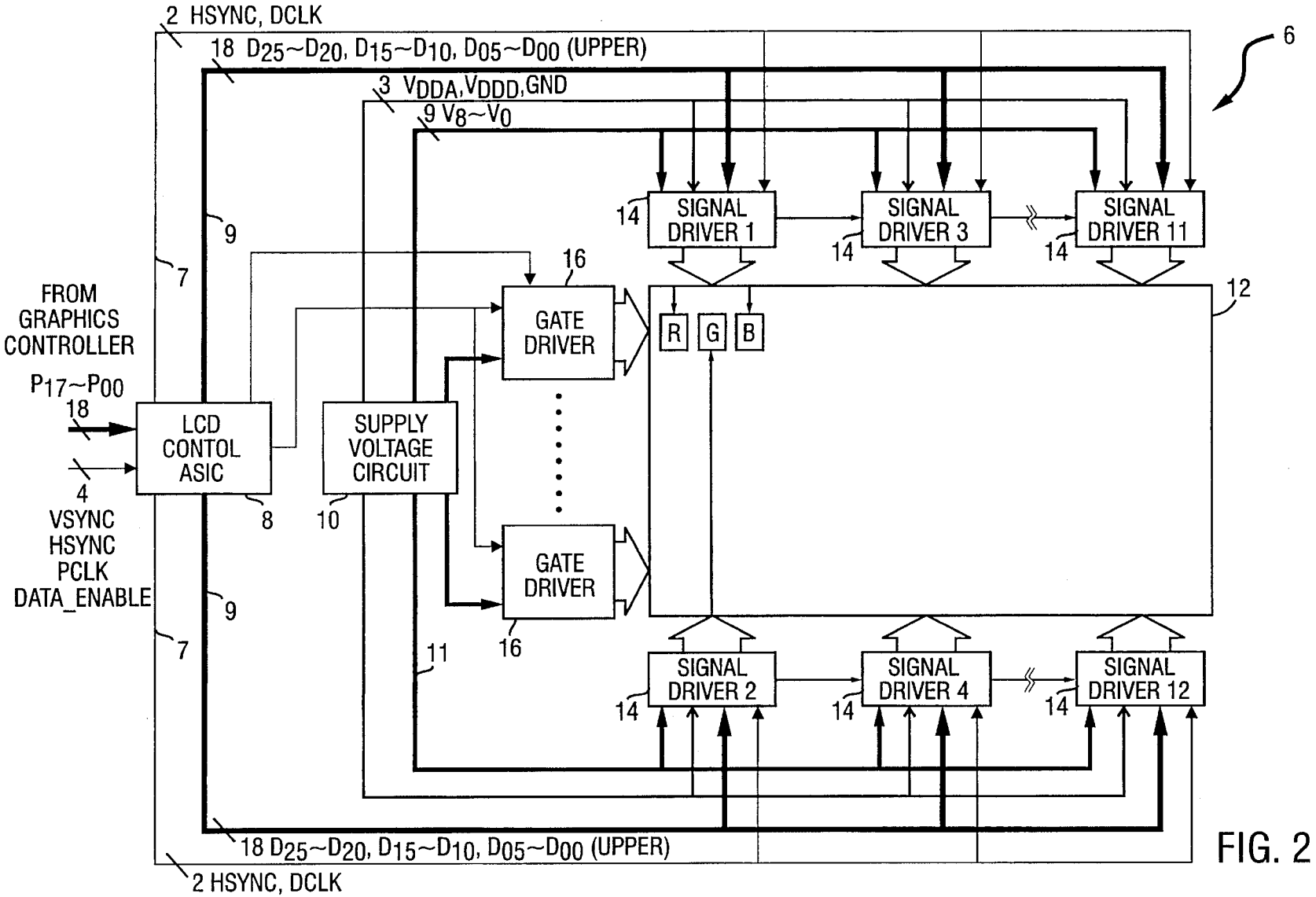
FIG. 2 is a block diagram of the circuitry within the liquid crystal display module.

FIG. 2 is an overview of the circuitry typically contained within LCD module 6. For example, LCD module 6 may contain an LCD control ASIC 8, a voltage supply circuit 10 and color LCD panel 12. LCD panel 12 may be, for example, a thin-film transistor LCD ("TFT-LCD"). LCD panel 12 is generally driven by column and row drivers. For example, columns may be driven by signal drivers 14 and rows driven by gate drivers 16. Generally, signal drivers 14 receive digital video data from LCD control ASIC 8 via bus 9, control signals via bus 7 and analog supply voltages from supply voltage circuit 10 via bus 11. The present invention is not limited, though, to the specific LCD module shown in FIG. 2.

Signal drivers 14 provide an analog voltage output signal to each column. Furthermore, signal drivers 14 provide a varying analog output voltage such that a desired gray scale may be obtained for the pixels within LCD panel 12. Generally, a plurality of signal driver units are used to drive the columns of an LCD panel. For example, an LCD panel having 1,920 columns may be driven by 10 signal drivers 14 if each signal driver 14 is capable of driving 192 columns or more.

Figure 3:
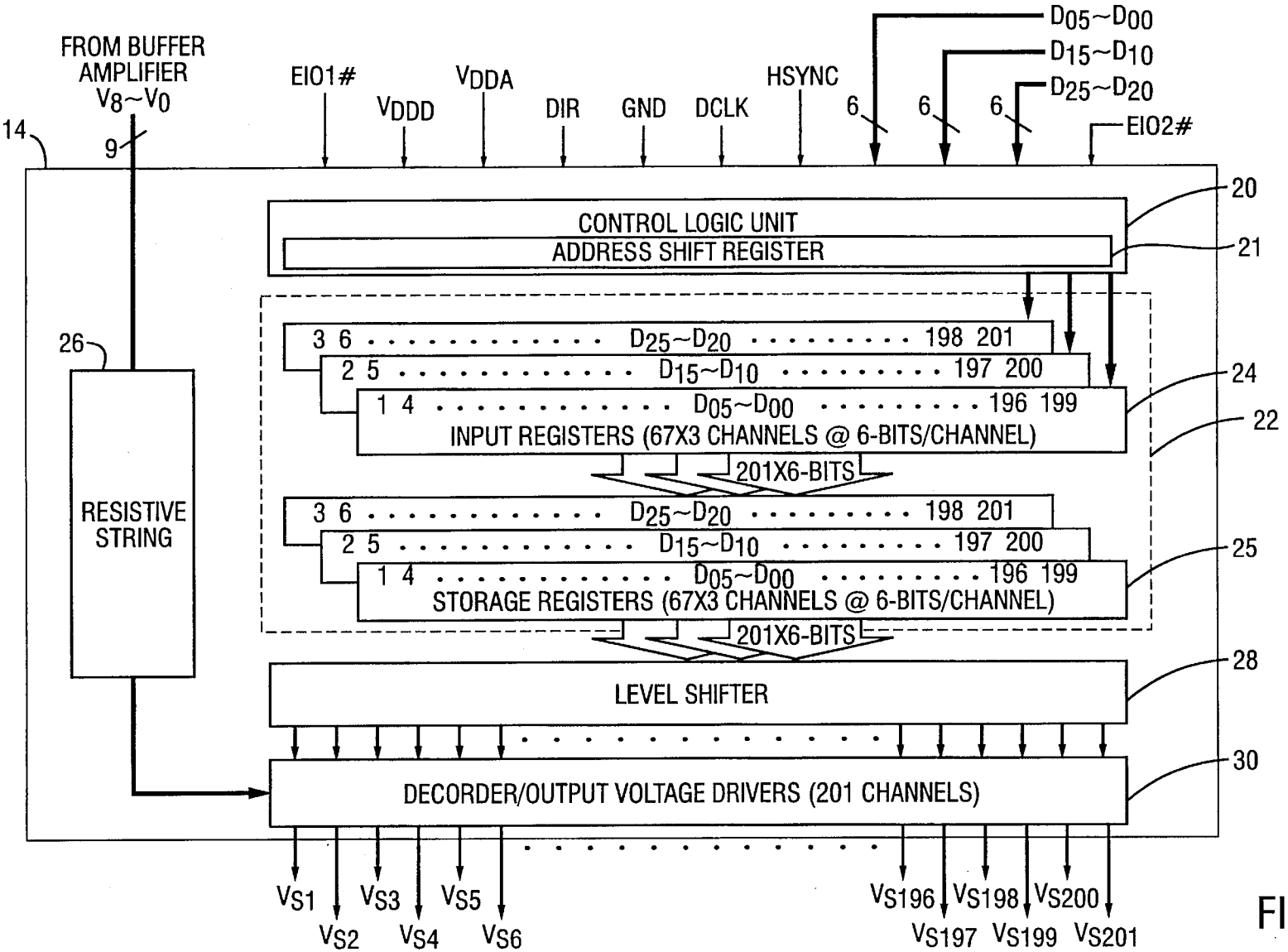
FIG. 3 is a block diagram of the circuitry within an embodiment of a signal driver according to the present invention.

FIG. 3 shows an overview of a driver circuit embodiment of the present invention. Each channel of each signal driver 14 (also called a source, data or column driver) generates and outputs a highly accurate analog voltage to LCD 12. The output voltage level is based upon the corresponding sub-pixel data from the graphics controller 4. A channel refers to a signal driver output (or physical LCD pixel) and its associated circuitry. For LCDs with color filters, a channel corresponds to a sub-pixel —red, green or blue. For monochrome LCDs, a channel corresponds to a pixel.

The block diagram in FIG. 3 shows the internal architecture of signal driver 14, which comprises seven major sections: control logic unit 20; address shift register 21; data registers 22 including input registers 24 and storage registers 25; resistor string 26; level shifters 28; and decoder/output voltage drivers 30.

The control logic unit 20 coordinates the signal drivers input and output functions, generates internal timing signals, and provides an automatic standby mode. During the standby mode, the majority of the internal circuitry of signal driver 14 is powered down to minimize power dissipation.

The address shift register 21 contains an N-bit shift register, where N is the number of uniquely addressable channels within signal driver 14. The direction of shift of shift register 21 is determined by the logical state of the DIR pin. The shift register 21 is clocked with the DCLK.

In a first embodiment of signal driver 14, there are 201 input registers 24, each comprising three sets of 67 latch circuits which latch 201 six-bit words of input display data. In a second embodiment, there are 192 input registers 24, each comprising three sets of 64 latch circuits which latch 192 six-bit words of display data. Each latch circuit contains three six-bit planes, where each plane corresponds to the significance of the input display data. (Note: $D_{15}$ is the most significant bit (MSB) and $D_{10}$ is the least significant bit (LSB)).

In first embodiment, storage registers 25 store 201 channels of six-bit display data for one line period (192 channels of sixbit data for the second embodiment), enabling the decoder 30 to use the display data from line time x while the next line of data (from line time x+1) is loaded into the input registers 24. The contents of the storage registers 25 are over-written with the next line of 201 (or 192) six-bit words of display data from the input registers 24 after a low-to-high transition occurs on HSYNC at the end of line time x+1.

An internal resistor string 26 used for voltage dividing, which may comprise a string of 64 resistors, produces 64 distinct voltage levels from the 9 voltage reference inputs ($V_0$–$V_8$). Linear voltage levels are generated between each pair of adjacent reference voltage inputs, utilizing a string of 8 resistors between the reference voltages.

Decoder 30 selects the desired output voltage based upon the data in the storage register 25 for each of the 201 (or 192) channels. As the display data for line x+1 is loaded into the input registers 24, the decoder 30 uses the data for line x stored in the storage registers 25.

Each of the output voltage drivers 30 outputs one of 64 analog voltages based upon the corresponding decode of the display data. The first embodiment contains 201 output voltage drivers 30, the second embodiment has 192. The analog voltage outputs are simultaneously applied from all channels of all signal drivers to the current row on the LCD 12 when a low-to high transition occurs on HSYNC.

As seen in FIGS. 2 and 3, the graphics controller 4 outputs three channels of pixel data $P_{17}$~$P_{00}$ (six-bits per channel for a total of eighteen-bits) in parallel along with the horizontal sync (HSYNC), vertical sync (VSYNC), pixel clock (PCLK) and data enable (Data_Enable) signals to a Control ASIC 8 in the LCD module 6. The LCD control ASIC 8 re-formats the pixel data and outputs three channels of data in parallel to each signal driver 14.

The present invention supports a variety of LCD pixel resolutions, Simulscan™ of CRT and LCD displays and various frame frequencies. Additionally, the invention may be used in a single bank or dual bank configuration to drive the LCD's channels (pixels).

The LCD control ASIC 8 outputs three six-bit words in parallel (eighteen-bits—six-bits each for the Red, Green and Blue sub-pixels) to each bank of signal drivers 14. If two banks of signal drivers 14 are used (as shown in FIG. 2), the LCD control ASIC 8 divides the input data into separate data streams for each bank, such that the data rate is one-half the input pixel data rate. If a single bank of signal drivers 14 is used, the data rate is equal to the input pixel data rate. The LCD control ASIC 8 generates and outputs the HSYNC and DCLK signals to the signal drivers 14.

As shown is FIG. 3, signal driver 14 receives the following signals as inputs: Enable In/Out (EI01# and EI02#) signals; data shift direction control (DIR) signal; Data Clock (DCLK); Data ($D_{25}$~$D_{20}$, $D_{15}$~$D_{10}$, $D_{05}$~$D_{00}$); and Horizontal Sync (HSYNC) signal.

The Enable Input/Output signals (EI01# and EI02# ) provide two functions. First EI01# and EI02# "enables" the signal driver 14. The signal driver 14 is normally in a low power standby mode and is activated by the high-to-low transition of the EI0x# (Enable In) input. After the high-to-low transition on EI0x# is detected (and the standby mode is exited), the signal begins to latch the input data. Second, EI01# and EI02# allows the currently active signal driver 14 to enable the next signal driver 14 by driving the EI0x (Enable Out) output low, once 201 (or 192) data words are latched.

The shift direction of the signal driver 14 is controlled by the status of the DIR input signal. The DIR signal provides the signal driver 14 with the flexibility for the display data to be input from either channel 1 to channel 201 (or 192) or from channel 201 (or 192) to channel 1.

When the DIR signal is tied to $V_{DDD}$ (DIR=1), display data input is enabled by a low-going signal on the EI02# input. Three channels of data (eighteen-bits) are input into the driver 14 on the falling edge of every DCLK. After the display data for all channels are latched into the input registers 24, the signal driver 14 automatically enters a low-power standby mode, and the EI01# signal is driven low on the falling edge of the $67^{th}$ (or $64^{th}$) DCLK. The EI01# signal is reset to the inactive state (high) with the next low-to-high transition of the HSYNC signal.

Each of the 201 (or 192) channels' output voltage is simultaneously output to the LCD 12 on the HSYNC rising edge. The voltage level decoded by the first data word of display data is output from pin $V_{S201}$ (or $V_{S192}$), and the level decoded by the last word of display data is output on pin $V_{S1}$.

When the DIR signal is tied to GND (DIR=0), display data input is enabled by a low-going signal on the EI01# input. After the display data for 201 (or 192) channels are latched into the input registers, the signal driver 14 automatically enters a low power standby mode and the EI02# signal is driven low on the falling edge of the $67^{th}$ (or $64^{th}$) DCLK. The EI02# signal is reset to the inactive state (high) with the next low-to-high transition of the HSYNC signal. The output voltage level selected by the first data word of display data is output from pin $V_{S1}$, and the level selected by last word of display data is output on pin $V_{S201}$ (or $V_{S192}$).

The signal driver 14 samples the data signals on the falling edge of the DCLK signal. The LCD control ASIC 8 must shut down the DCLK during the HSYNC active period.

Each time the signal driver 14 is enabled (EI0x#, Enable In, is low), three six-bit words Data ($D_{25}$~$D_{20}$, $D_{15}$~$D_{10}$, $D_{05}$~$D_{00}$) of display data for three channels are latched in parallel into the input registers 24 on the falling edge of DCLK. After 67 (or 64) transitions of the DCLK, data for all 201 (or 192) channels (3×67 or 3×64) have been input. After the $67^{th}$ (or $64^{th}$) DCLK pulse, the signal driver 14 returns to the standby mode to minimize power consumption.

Each low-to-high transition on HSYNC causes the following. The contents of the 201 (or 192) input registers 24 are transferred to the storage registers 25, enabling the input registers 24 to be filled with the next line of display data during the next line time. The output voltage drivers 30 update the output voltage to the LCD 12 simultaneously for all 201 (or 192) channels. The EI01# or EI02# signals are reset to inactive (high) state.

The Enable Out pin is driven low with the falling edge of the $67^{th}$ (or $64^{th}$) DCLK. The Enable Out may be connected to an adjacent signal driver Enable In pin such that subsequent data may be loaded in the adjacent drivers 14. The EI01# input to the first signal driver 14 is grounded. This means that the first signal driver 14 latches the display data on the falling edge of the first available clock. The system implementation should ensure that the data clock (DCLK) input is gated with the Display_Enable signal so that data is valid with the first available DCLK. After the $67^{th}$ (or $64^{th}$) DCLK pulse, the signal driver 14 returns to the standby mode to minimize power consumption.

Each output voltage driver 30 generates a number of precise analog voltages (for example, 64). Each output voltage driver 30 begins to output one of a number of voltages to the LCD panel 12 simultaneously for all 201 (or 192) channels after the rising edge of HSYNC.

The decoder 30 selects the desired output voltage level based upon the data in the storage register 25 for each of the 201 (or 192) channels.

An internal resistive DAC 26, which may comprise a string of 64 resistors, produces linear voltage levels between any pair of adjacent reference voltages.

The supply voltage circuit 10 shown in FIG. 2 generates all the voltages required by the LCD panel 12. Signal driver 14 requires the following power supplies and reference voltages: one digital supply voltage ($V_{DDD}$); one analog supply voltage ($V_{DDA}$); nine reference voltages ($V_8$–$V_0$).

Figure 3A:
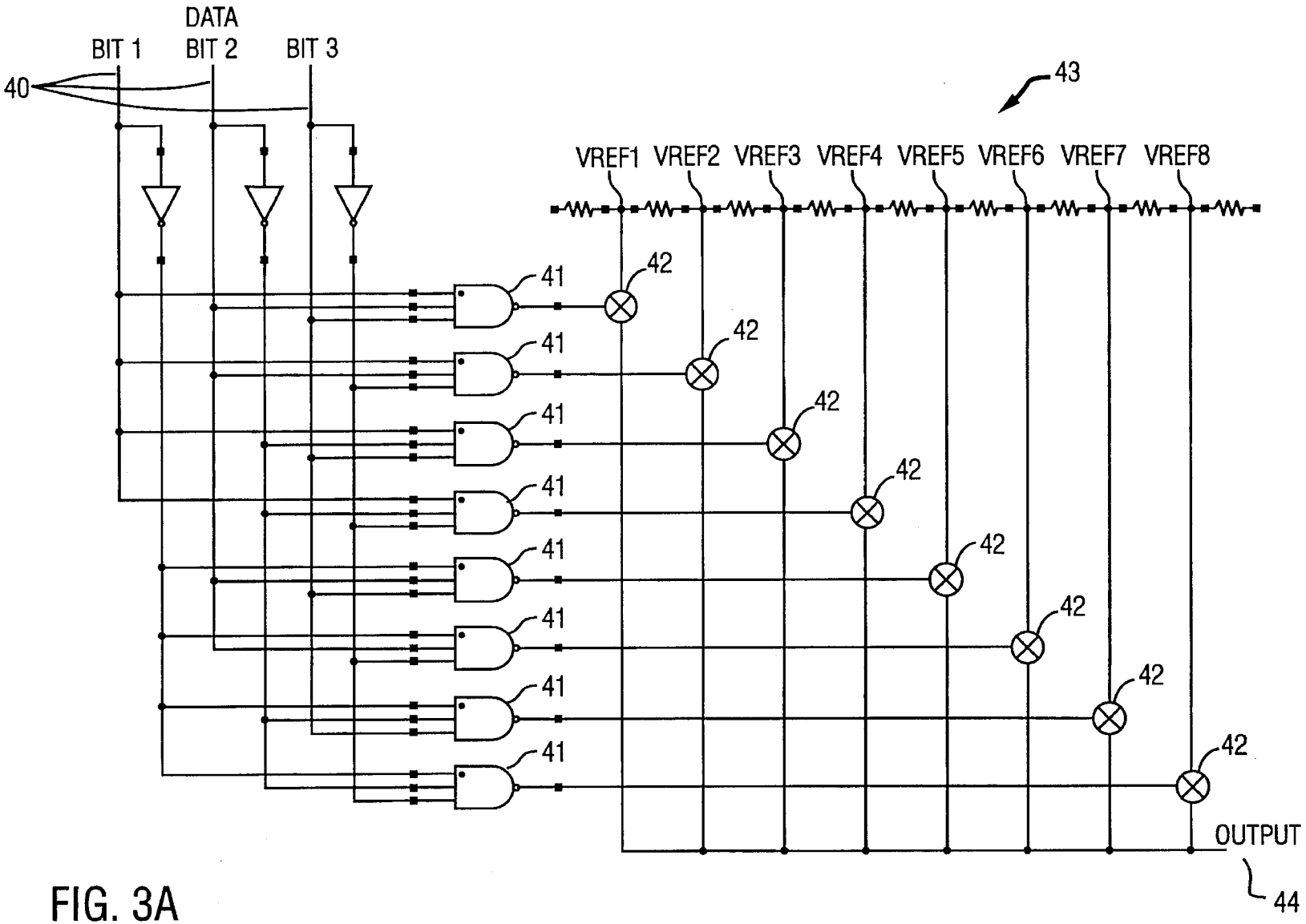
FIG. 3A is a functional schematic of a decoder circuit for a signal driver according to the present invention.

Signal driver circuit 14 shown in FIG. 3 provides up to sixty-four voltage levels on each of two hundred one LCD columns. It will be recognized, though, that more or less voltages or columns may be utilized. Within signal driver 14, decoder/output voltage drivers 30 are used to provide a specific voltage output to each column. The interaction between decoder/output voltage drivers 30 and resistive string 26 may be seen more clearly in FIG. 3A. FIG. 3A functionally illustrates a decoder circuit for one column and full digital decoder architecture that may be utilized by the decoder. For illustrative purposes, FIG. 3A presents only eight voltage levels. Thus, three data bits are needed to select the eight voltage levels. It is recognized that any number of voltage levels may be selected, for example, signal driver 14 may utilize sixty-four voltage levels which would require six data bits to select the desired levels. In general, $2^N$ voltage levels may be used, where N is the number of data bits.

In FIG. 3A, digital data bit lines 40 and their complements are supplied to a series of NAND gates 41. Each NAND gate 41 is connected to select one of the eight possible digital states. Connected to NAND gates 41 are analog switches 42. Analog switches 42 are also connected to resistive string 43. One analog switch 42 is provided for each desired voltage output, for example, as shown in FIG. 3A, eight switches 42 are for eight possible voltage outputs. Thus, the circuit shown in FIG. 3A uses full digital decoding logic to convert digital data on data bit lines 40 to an analog voltage output 44. Though not shown in FIG. 3A, switches 42 may utilize both the output of NAND gates 41 and the inverted output of NAND gates 41.

Figure 3B:
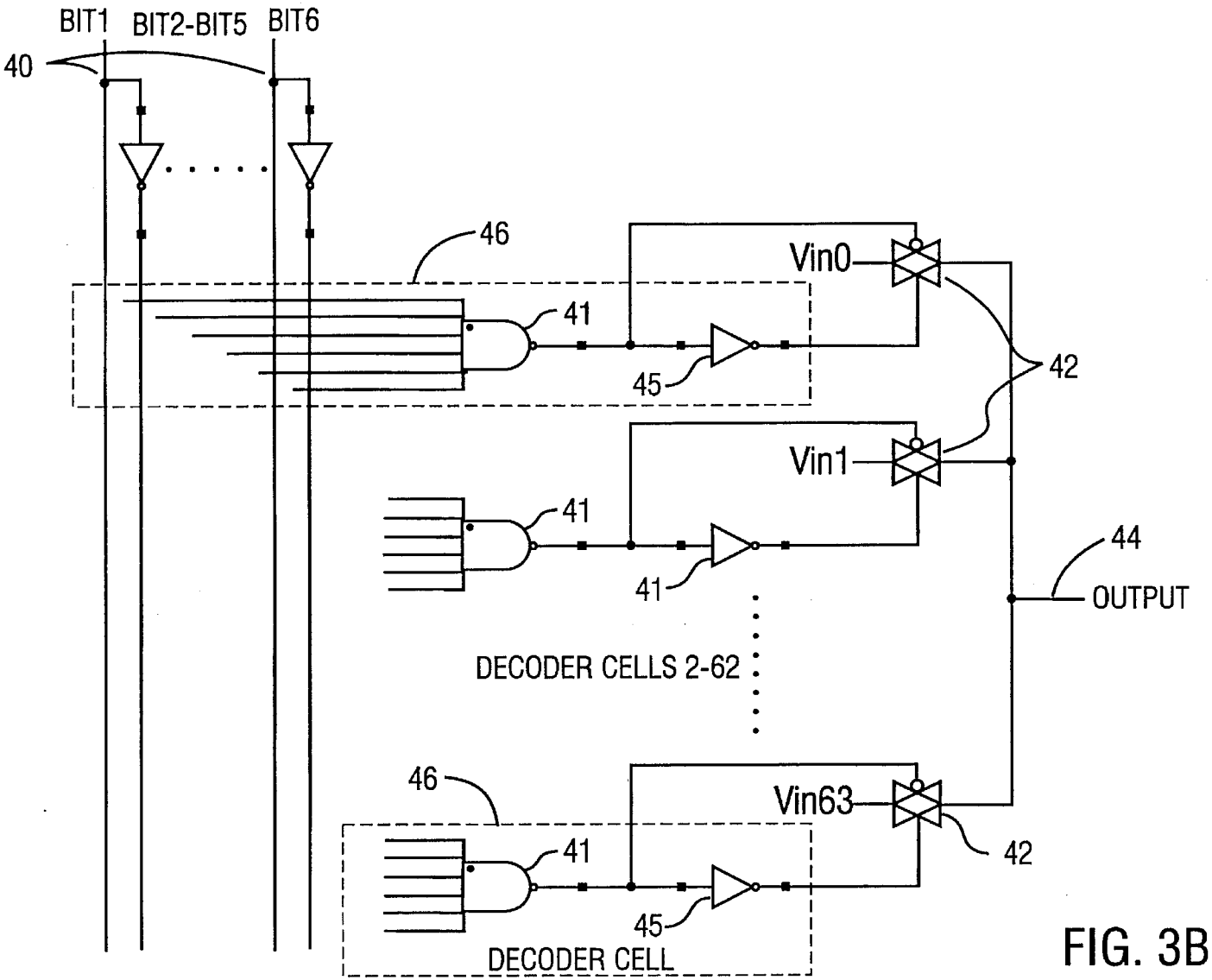
FIG. 3B is a schematic of decoder logic utilized in the present invention.

FIG. 3B is the full digital decoder logic used to select one of the sixty-four analog output voltages $V_{in0}$–$V_{in63}$. Sixty-four NAND gates 41 are connected to six-bit lines 40, each NAND gate 41 being connected to select one of the sixty-four possible digital states. The inverted output of each NAND gate 41 is also provided to switch 42 as shown in FIG. 3B. As shown in FIG. 3B, inverter 45 and NAND gate 41 may be together considered decoder cell 46. Thus, for sixty-four possible analog outputs, sixty-four decoder cells (cells 0–63), sixty-four analog switches and sixty-four analog voltages are used. It will be recognized, though, that as used herein a decoder cell may also include switch 42. In general, a cell is simply a repeated structure used to decode a specific decode state to provide a voltage to an output of the signal driver.

As with reference to FIGS. 3A and 3B and as discussed above, resistor strings or resistor voltage dividers may by used for supplying the voltage levels that may be switched to a column output. In one embodiment of the present invention, sixty-four different voltage levels are utilized by placing in series eight resistors between each of nine voltage reference voltages supplied to the signal driver chip bonding pads. This arrangement serves to provide a plurality of analog voltages to generate a digital code-output voltage curve that is tailored to match the non-linear characteristics of a particular LCD panel's transmissivity-voltage response. The use of nine voltage references allows for an eight segment piecewise-linear approximation of the desired code-voltage response. Voltage references $V_0$ and $V_S$ define the extremes that the driver can provide while reference voltages $V_1$–$V_7$ define the shape of the curve between $V_0$ and $V_S$ in a piecewise-linear fashion. Thus, the approach of this resistor string digital to analog converter (DAC) architecture requires at least 64 individual resistors of moderate electrical value (of approximately 40 ohms each in one embodiment). In order to prevent metal resistance from causing noticeable and undesirable errors, the total metal resistance from bonding pad to the resistor string must be small compared to the smallest resistor segment corresponding to one least significant bit of the DAC (40 ohms). If the desire code-voltage curve was linear there would ideally be no DC current supplied from $V_1$–$V_7$ while $V_0$ and $V_S$ would be required to source/sink the entire current of the resistor string such that it is most important to reduce the metal resistance from the pad to the string $V_0$ and $V_S$. As $V_1$–$V_7$ are deviated from the linear case, they must source or sink a "difference" current required to change the shape of the curve while $V_0$ and $V_S$ supply the remainder of the string current. Therefore, it is also important to minimize the metal resistance for the other references as well. Because signal driver chips may be long, the metal runs themselves may have significant resistance. For example, a minimum width run of metal from one end of the chip the other could be as much as 700 to 800 ohms.

To place the 64 resistors near one end of the chip would result in long metal runs from the reference bonding pads to the resistors and/or from the resistor strings to decoder cells and possibly unacceptably high resistance. Furthermore, the resistance from each of the nine references should be equal, or at least bounded by some reasonable maximum range, in order to satisfy typical accuracy requirements. In addition, too much metal resistance from the resistors to any output can create different delays from one channel to another, creating visual banding.

It is therefore desirable to place the resistors strings such that long metal runs from the reference pads to the resistors, or from the resistors to the outputs, or both are avoided.

Placing a single resistor string in the middle of the circuit keeps the dc resistance error term reasonably small, and by placing the reference pads across the top of the chip and symmetrical about the center line, minimization of dc resistance from metal is readily achieved. However, the metal line from the resistor string in the center of the chip to decoder cells near the ends of the chip may have resistance which could approach 350–400 ohms, which would cause some outputs to have different ac performance which could be noticeable.

Therefore, the present invention utilizes distributed resistors having two parallel resistor strings placed such that the maximum distance from any decoder cell to a resistor string is equalized across the chip. Thus, dc resistances may be minimized as well as differences between the ac settling characteristics from channel to channel. The worst-case metal resistance from any resistor to any output is ¼ of the metal resistance from end to end of the circuit. In addition, by placing the reference pads symmetrically with the vertical center line of the chip, it is possible to minimize and equalize the metal resistance of each reference from pad to resistor. It will be recognized that if three resistor strings are used, the worst case distance will be ⅙, if four strings are used, ⅛, etc.

One additional way to prevent different metal resistances from resistors to pads is by folding the resistor string into a U-shape structure, which allows both the bottom and the top connections to each resistor string to be made near the top of the chip, which allows the minimum metal distance between pad and resistor. For example with reference to a 9 reference voltage embodiment, while there are 9 total references, the two most sensitive to metal resistance are the top and bottom connections, because these carry the most current. In spite of these low resistance connections for two of the reference levels, there are an additional seven references which traverse different distances from pads to resistors. In order to maintain a worst-case small time constant with the folded resistor arrangement described above, the horizontal metal busses to distribute the reference potentials to resistors need to be as wide as possible to keep their resistance low. In order to keep die size as small as possible, each reference line is only made as wide as necessary to keep the overall worst-case metal resistance at a minimum. This results in metal busses for different references which are of different widths. This results in minimum time constant with a minimum of die area expanded.

Figure 3C:
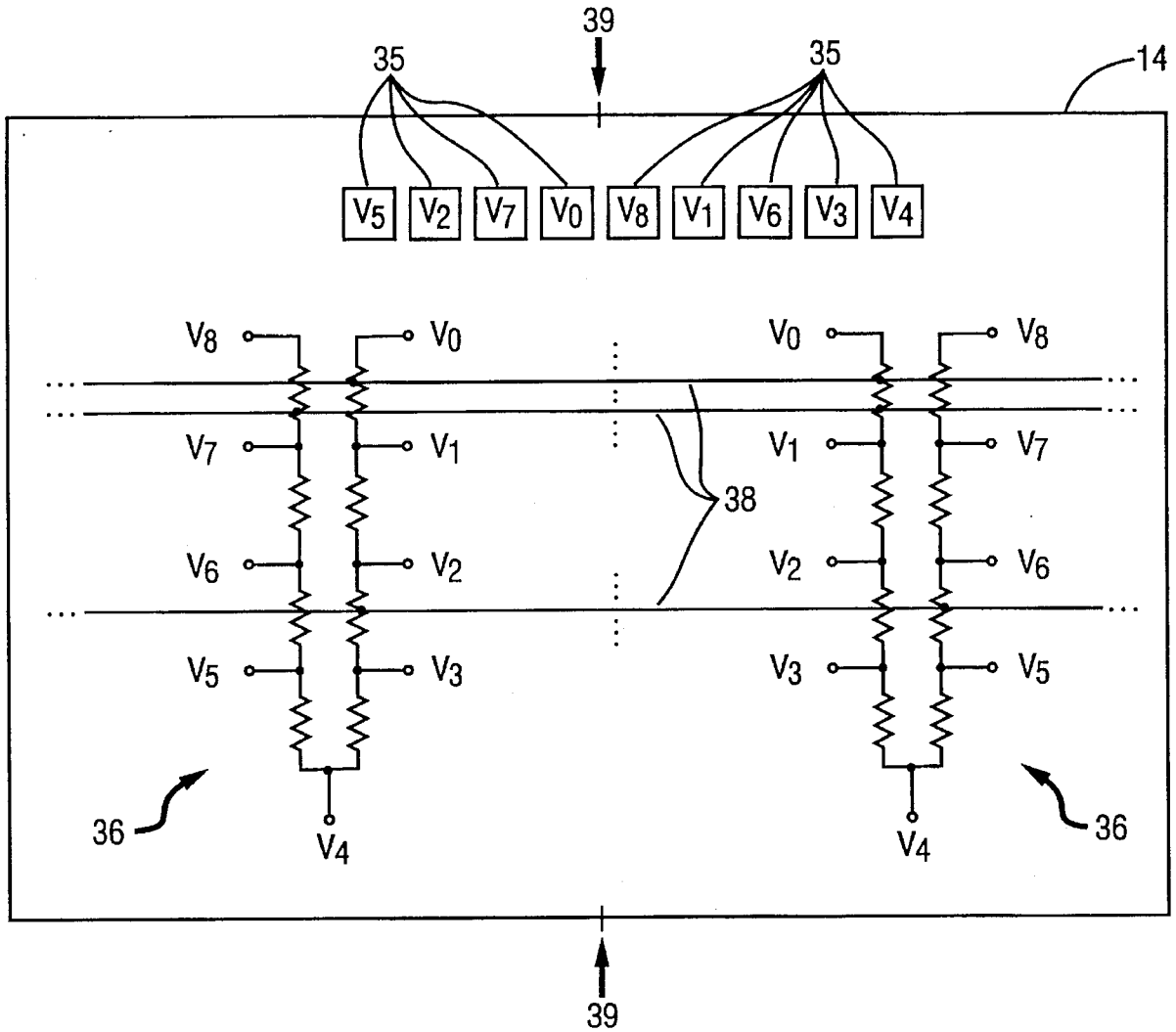
FIG. 3C is a block diagram of a signal driver chip having distributed resistor strings.

Though not shown to scale, a signal driver circuit using resistor strings or voltage dividers according to the principles discussed above is shown generally in FIGS. 3C and 3D. In FIG. 3C, signal driver chip 14 has nine reference voltage bond pads 35 for reference voltages $V_0$–$V_8$ centered about midpoint 39. Two U-shaped resistor strings 36 are provided at locations approximately ¼ and ¾ across the length of the chip. Columns of decoding cells and switches (not shown) are formed between resistor strings 36 and between each resistor string 36 and the ends of signal driver circuit 14. If 3 strings are utilized, the strings should be spaced equally such that the distance between adjacent strings is ⅓ the circuit length. Four strings would be spaced ¼ the circuit length, and so on. Therefore, preferably adjacent strings are spaced approximately 1/n the circuit length when n is the length of the circuit and the distance between the strings on either end of the circuit and the edge of the circuit is 1/2n.

Each resistor string 36 has voltage inputs $V_0$–$V_8$ which are tied together to the respective reference voltage bond pads 35 by respective conducting lines (not shown). Thus, parallel resistor strings are created. As shown in 3D, between any two adjacent resistor string voltage inputs, eight small resistors 37 are formed. Sixty-four conductors 38 connect the respective nodes of resistor strings 36 and provide a voltage input $V_{in}$ for each column of decoder cells across the chip.

FIG. 3C illustrates the electrical schematic of the resistor string. It will be recognized that the physical layout may take many forms. For example, as shown in FIG. 3E resistors 37 of a resistor string 36 may be interwoven. FIG. 3E shows such an interwoven layout for the portion of a resistor string 36 adjacent to $V_0$ and $V_8$. The remainder of the string may be similarly arranged.

Figure 3D:
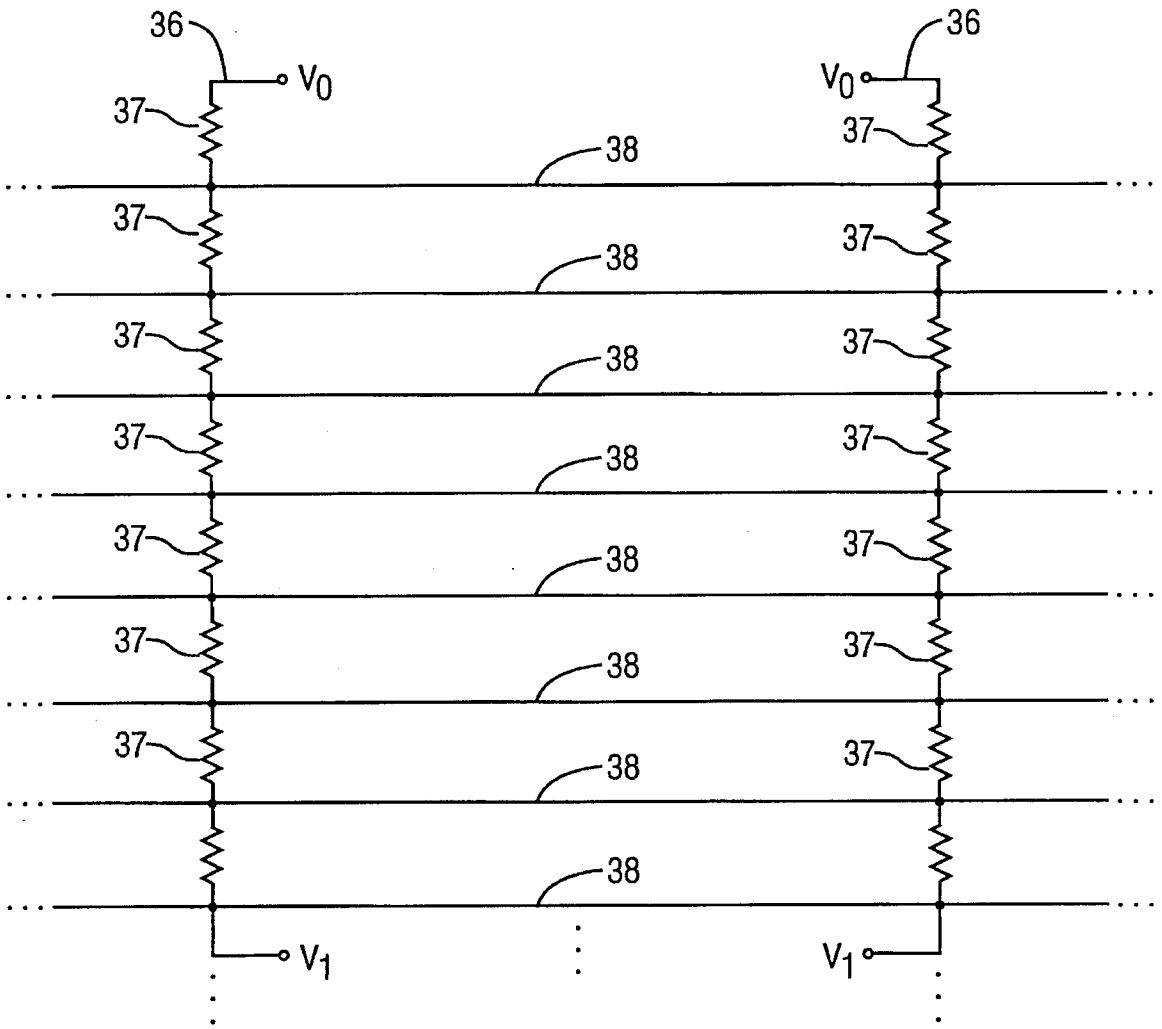
FIG. 3D is a schematic of a portion of the resistor strings shown in FIG. 3C.
Figure 3E:
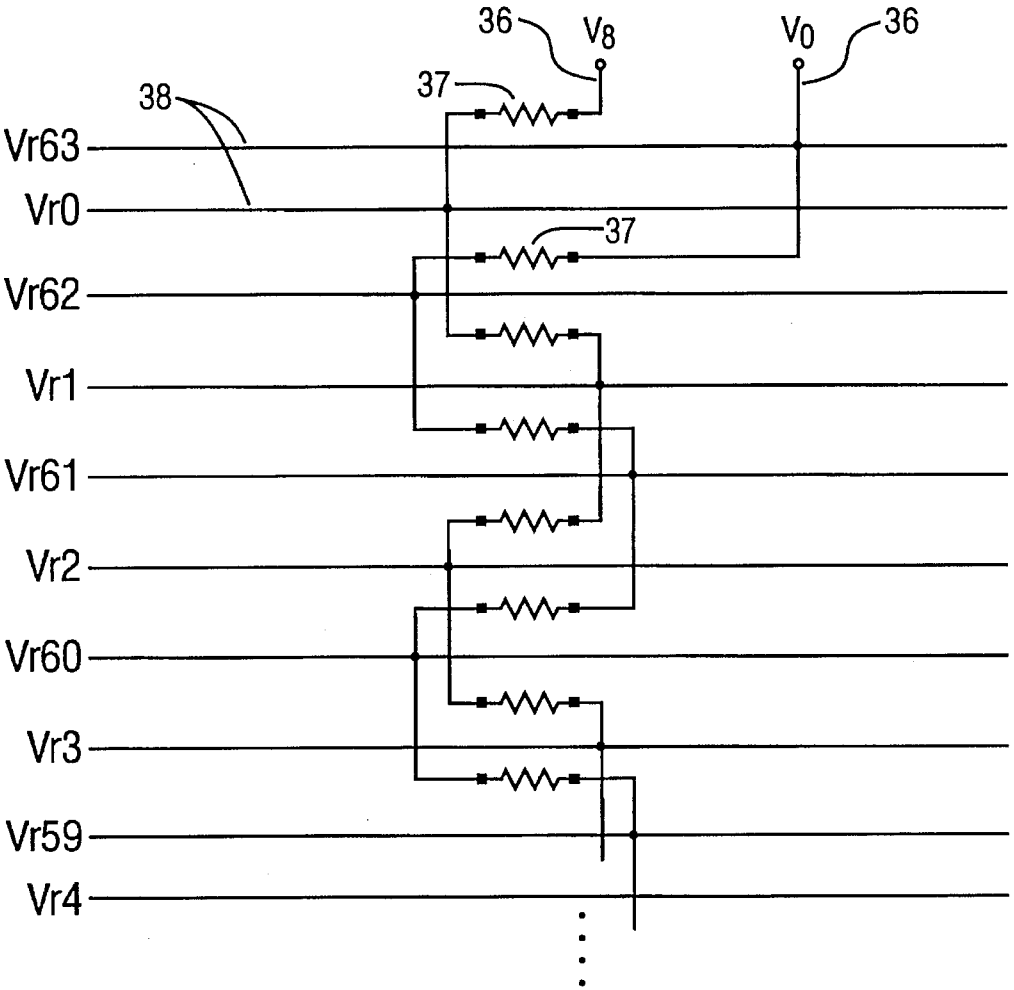
FIG. 3E is an embodiment of the layout of a resistor string shown in FIG. 3C.

As mentioned above, the two most sensitive portions of the resistor strings are the top and bottom (such as between $V_0$ and $V_1$, and between $V_7$ and $V_8$ in FIGS. 3C and 3D). Therefore, it is particularly desirable that the distances from the $V_0$ bond pad to the $V_0$ connection of each resistor 36 be approximately equal. Likewise, the $V_8$ distance is preferably equal. Thus, $V_0$ and $V_8$ bond sites are the closest bond sites to the midpoint 39 of the circuit. By creating parallel resistor strings and keeping the distance from a given bond pad 35 to the corresponding input node of each resistor strings 36 approximately equal, the metal lead resistance from the bond pad to each string 36 (for example, the left or right resistor strings 36 in FIG. 3C) is approximately equal, and thus a more accurate voltage divider is provided.

Furthermore, a more accurate voltage divider is obtained if the first and last resistors (i.e., those adjacent to the $V_0$ and $V_8$ inputs) are adjusted slightly to compensate for the resistance in the metal lines from the bond pad to the resistor string input. Thus, for example, the resistance from the bond pads to the $V_0$ input plus the resistance across the first resistor should equal the resistance across the next 62 resistors in the string. The last resistor in the string may likewise be adjusted.

Power dissipation is a major consideration in many LCD modules because the modules often use battery power sources. According to the present invention, it is recognized that a non-trivial amount of the total power dissipation of an LCD module is caused by charging parasitic capacitances on the clock and data lines to the driver chips, such as bus lines 7 and 9 in FIG. 2. The voltage of such capacitive lines impacts the power dissipated within such lines because the power (P) dissipated by charging and discharging a capacitor (having capacitance C) at a frequency (f) and voltage (V) can generally be shown as:

$$p=CV^2f$$

The operating voltage of the signal driver digital circuitry also impacts the power dissipation since generally lower operating voltages results in lower power dissipation. Thus, to reduce power dissipation it is desirable to operate the LCD module and driver circuit at lower voltages.

However, in order to obtain high LCD pixel contrast ratios a high analog output voltage range, 5 volts for example, is typically desirable at each LCD panel column. Moreover, generally if an analog switch is to deliver up to a specific analog output voltage, such as 5 volts, then the control input to the switch must also operate at that voltage.

Therefore, according to the present invention, level shifting circuitry, such as level shifter circuitry 28 in FIG. 3, is utilized so that a portion of the signal driver operates at a voltage lower than the maximum analog output voltage. Level shifting circuitry allows portions of the LCD module and signal driver (particularly the high frequency portions and the high capacitance portions) to operate at a low operating voltage, such as 3.3 volts or lower, while the analog outputs may have a higher range, such as 5 volts.

Figure 4:
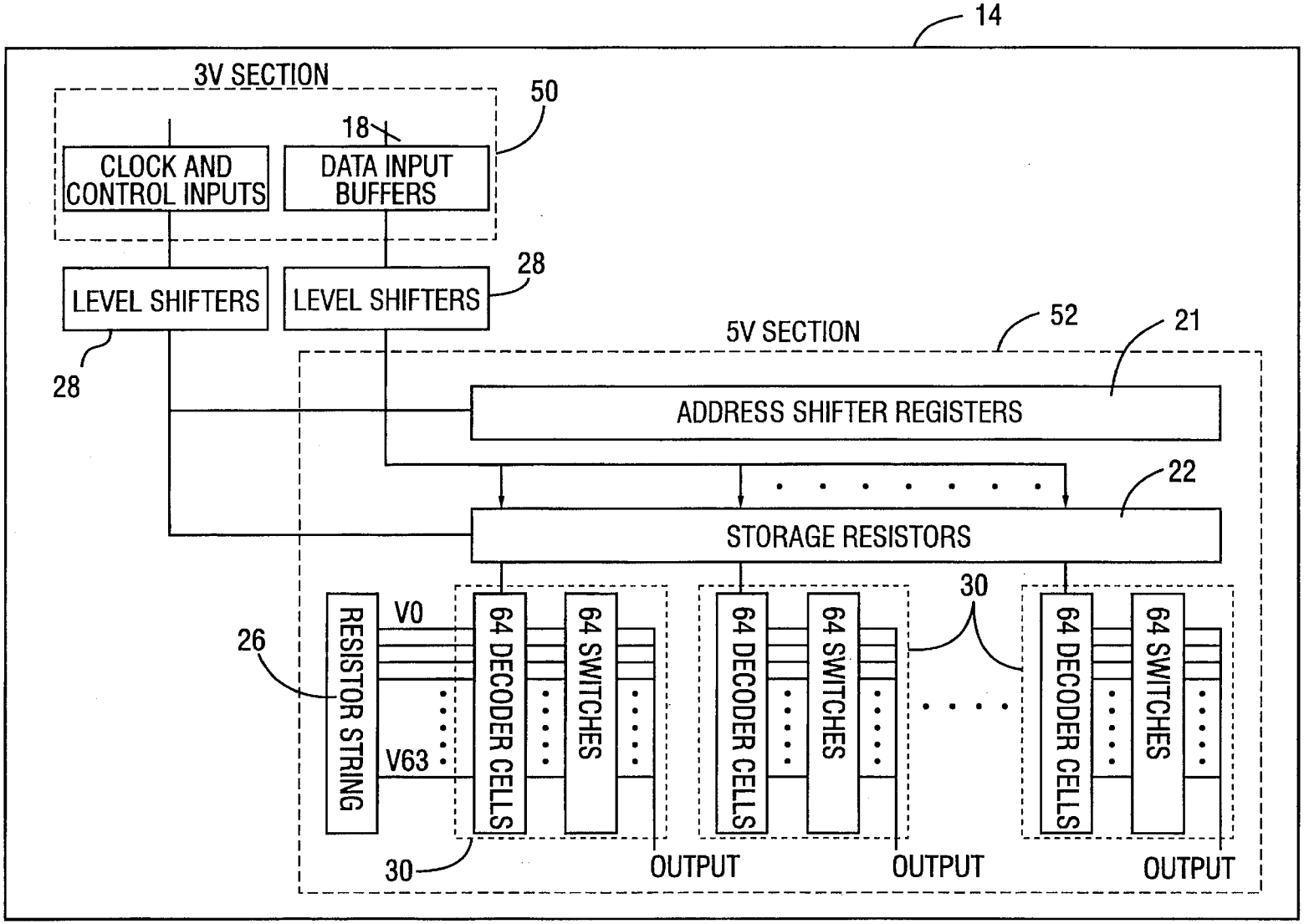
FIG. 4 is a block diagram of a signal driver circuit having level shifting.
Figure 5:
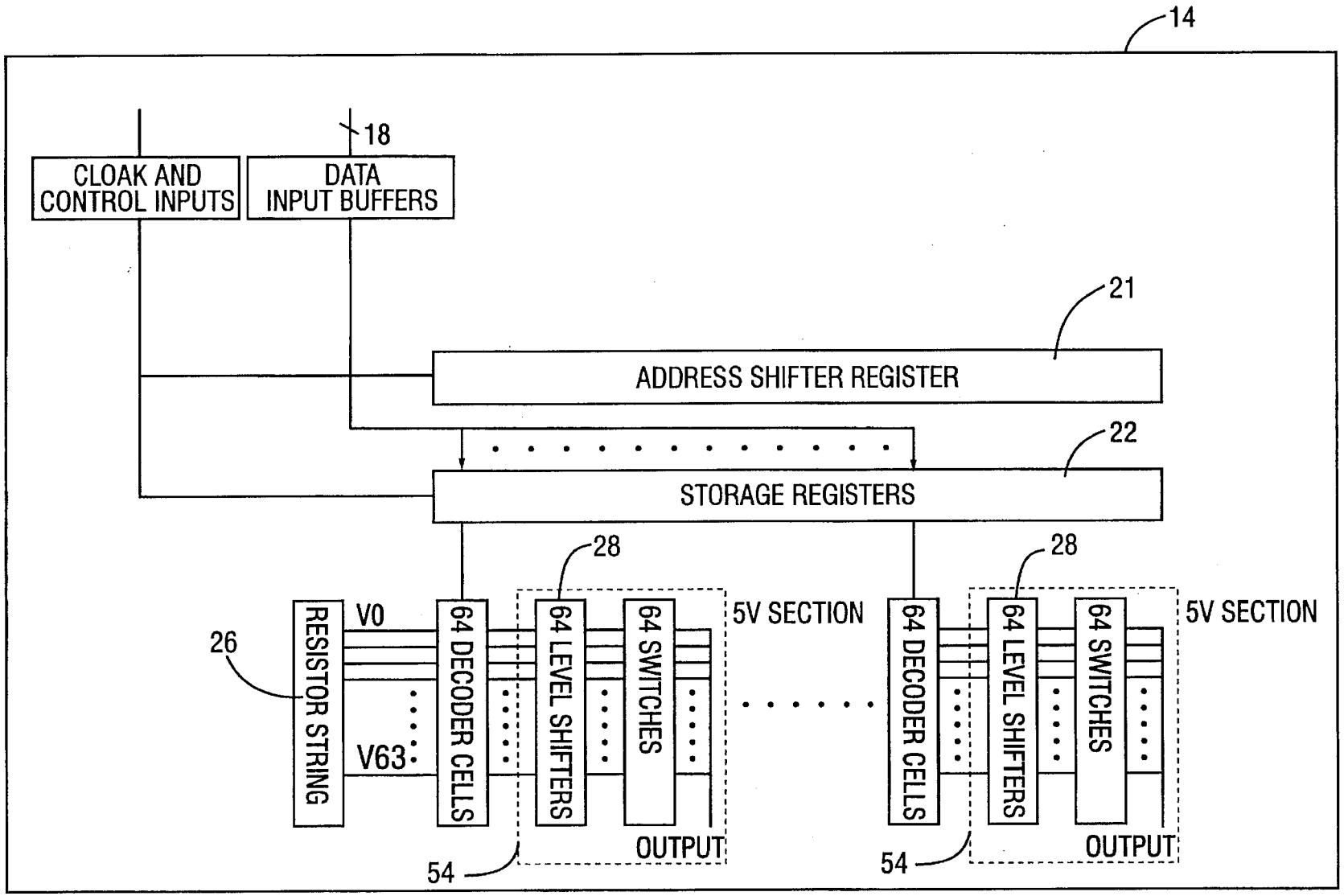
FIG. 5 is yet another block diagram of a signal driver circuit utilizing level shifting.

According to other embodiments of the present invention, level shifting, if desired, may be accomplished at a variety of other points inside the signal driver. FIGS. 4 and 5 are alternative level shifting embodiments of driver circuit 14. Driver circuit 14 in FIGS. 4 and 5 is similar to driver circuit 14 in FIG. 3; however, the placement of level shifter circuitry 28 is different between FIGS. 3, 4 and 5. The impact of the placement of the level shifter circuitry 28 may be more easily described when considering a signal driver that drives two hundred one outputs at sixty-four separate voltage levels. As shown in FIG. 3, level shifter circuitry may be placed between storage registers 22 and decoder circuitry 30. In this embodiment, 201×12 (201 outputs and 12 data lines per output) or 2,412 separate lines must be level shifted and, thus, 2,412 level shifter circuits would be employed. However, as shown in FIG. 4, the level shifters may be placed prior to the address shifter and storage registers, then only eighteen level shifter circuits would be employed for the data path (clocks and control signals would employ some additional level shifters). Finally, as shown in FIG. 5, level shifters may be employed with each specific analog switch such that for each analog output, sixty-four level shifters would be used, giving a total of 64×201 (12,864) level shifters used in signal driver circuit 14.

As discussed above, the location of the level shifters impacts the number of level shifters required. However, the location of the level shifters also impacts the amount of circuitry operated at a specific voltage level and, thus, the total power dissipation of the circuit. Though level shifting circuitry which is placed closer to the signal driver chip inputs requires fewer level shifters, the power dissipation advantages are less since less circuitry is operating at low voltages. For example, if operating levels of 3.3 volts and 5 volts are chosen, block 50 in FIG. 4 encompasses the 3.3 volt circuitry while block 52 encompasses the 5 volt circuitry. However, as shown in the embodiment in FIG. 5, if level shifters are associated with each switch at the output, then only block 54 need operate at 5 volts. Also, placement before the address shifter register requires the level shifters to operate at higher frequencies, thus adding to the complexity of the level shifter circuit. Thus, a number of factors impacts the optional placement of the level shifters.

Figure 6:
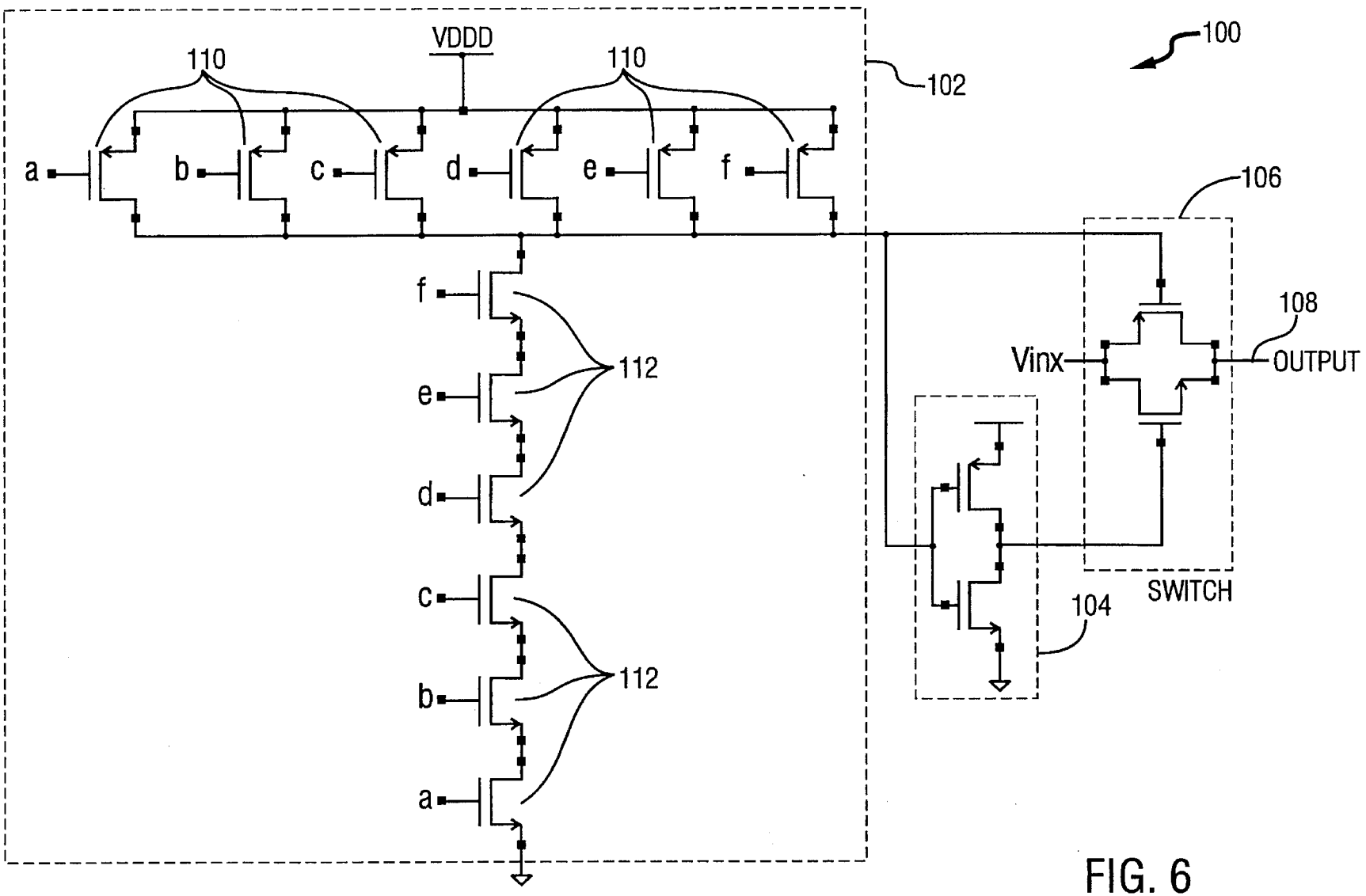
FIG. 6 is an electrical schematic of a decoder and associated circuitry.

FIG. 6 is a decoder cell schematic. The decoder cells in FIG. 6 may be used for decoder cell 46 in FIG. 3B or the decoder cells shown in FIG. 4. In FIG. 6, decoder cell 100 comprises NAND gate 102 and inverter 104. For illustrative purposes, a six data bit circuit (i.e. sixty-four output voltages) is used. The NAND gate data inputs are represented by data lines a, b, c, d, e and f. For illustrative purposes, a, b, c, d, e and f are chosen, and it will be recognized that depending on what six-bit number the decoder cell is programmed to decode, complemented data bits may be provided as the NAND gate input. NAND gate 102 includes a plurality of P-channel MOS devices 110 placed in parallel with each other as shown in FIG. 6. Furthermore, NAND gate 102 includes a plurality of N-channel MOS devices 112 placed in series as shown in FIG. 6. The output and inverted output (from inverter 104) of NAND gate 102 are then supplied to switch 106 such that a desired analog output voltage 108 may be supplied to an LCD column.

Figure 7:
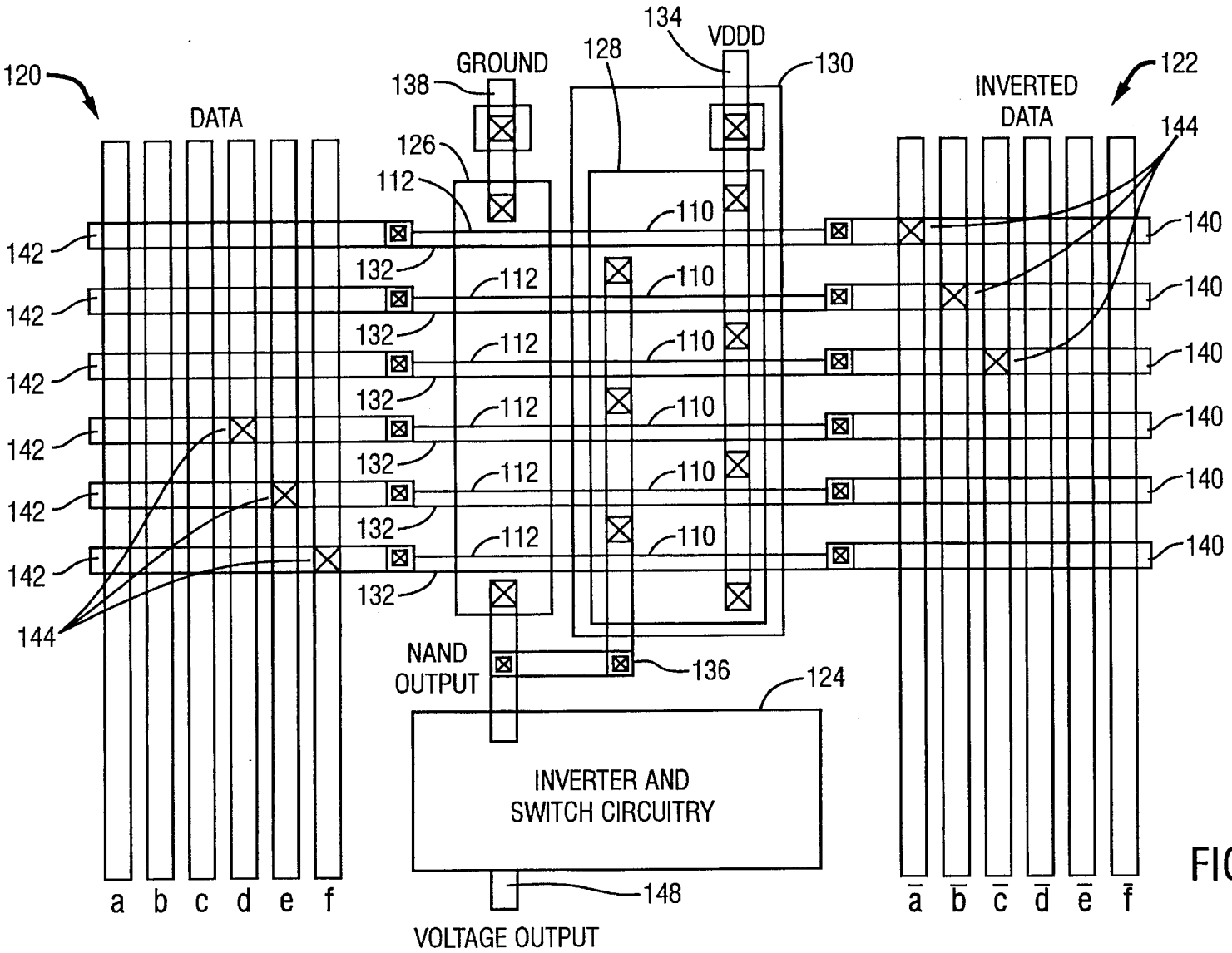
FIG. 7 is a cell layout of the schematic shown in Figure

The physical layout of the schematic shown in FIG. 6 may be seen in FIG. 7. Such a cell may be formed using conventional integrated circuit manufacturing technology typically in silicon. In FIG. 7, data bits a, b, c, d, e and f are delivered to each cell by a first set of parallel conductors 120. The inverted (or complement) data bits are delivered to each cell by a second set of parallel conductors 122. Preferably, conductors 120 and 122 are formed in a second metal layer, however, other conductors may be used. Block 124 generally represents inverter 104 and switch 108 (shown individually in FIG. 6). Block 126 represents the N-channel device area wherein N-channel transistors 112 will be formed. Block 128 represents the P-channel transistor region in which P-channel transistors 110 will be formed. Block 130 represents the N-well region associated with P-channel region 128. It is noted that the circuit shown is not drawn to scale. For example, those skilled in the art will recognize that general circuit layout requirements require a larger space between an N-channel region such as block 126 and an N-well region such as block 130.

Referring again to FIG. 7, conductors 132 are preferably polysilicon conductors used as gates for N-channel transistors 112 and P-channel transistors 110. Conductor 134 provides the common $V_{DDD}$ lines for P-channel transistors 110. N-channel transistors 112 connect in series between conductor 136 and ground 138. Conductor 136 connects to each P-channel transistor and to one N-channel transistor as shown in FIG. 7. Conductor 136, thus operates as the output line of the NAND gate structure.

Contacts or vias 144 to conductors 140 and 142 are used to program each decoder cell to select a specific six-bit number that is present on data lines 120 and 122. Preferably, conductors 140 and 142 are formed in a first metal layer. Programming of the decoder cell is accomplished by placing vias at the appropriate intersection of conductors 120 and 142 and the intersections of conductors 122 and 140. For example, as shown in FIG. 7, vias 144 are formed such that the cells shown decodes the six-bit a complement, b complement, c complement, d, e and f. Thus, the decoder cell enables a digital number present on the data lines to be decoded, and then the cell selects a switch so that the corresponding desired analog voltage output is selected for output 148.

Figure 8:
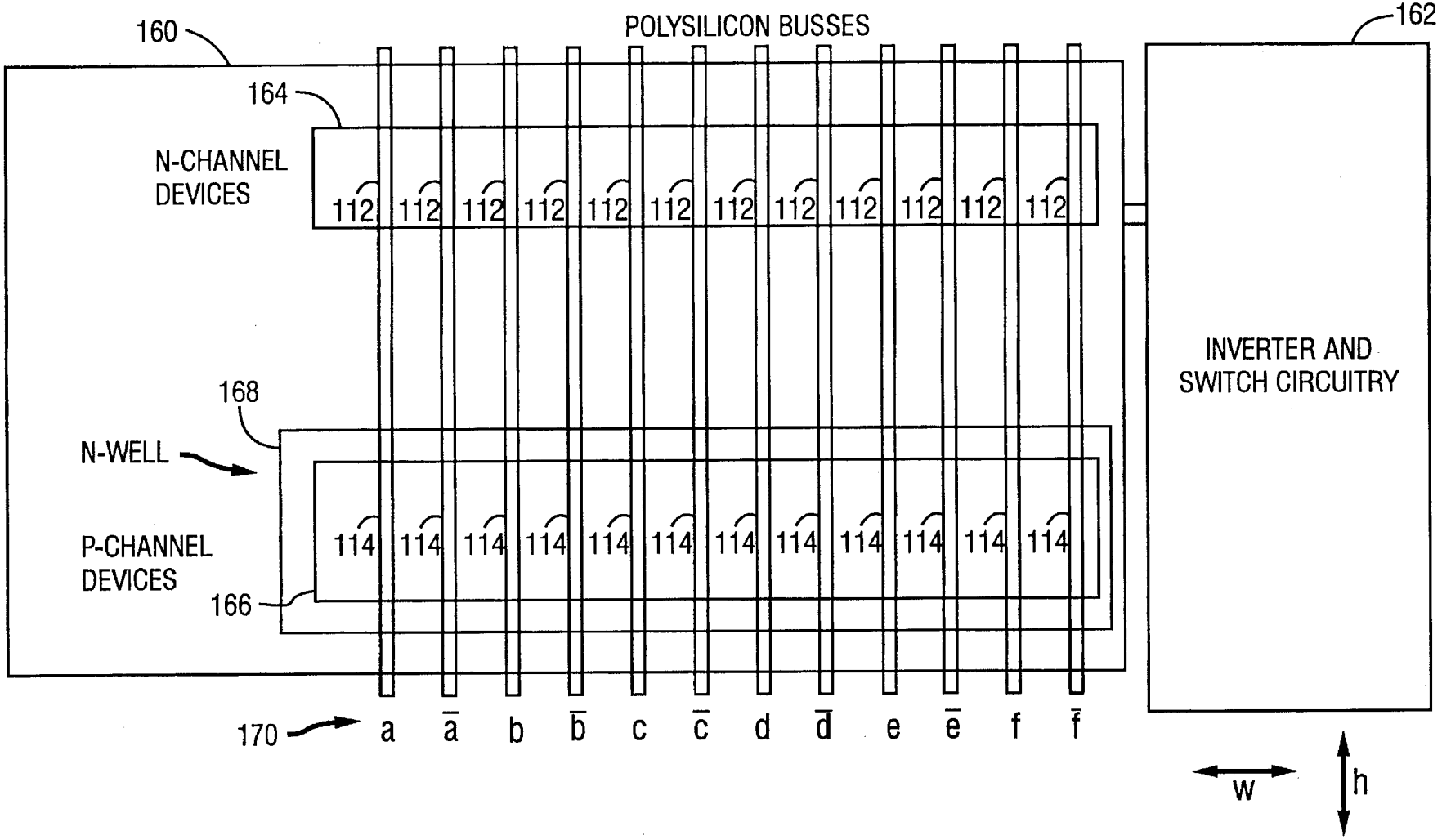
FIG. 8 is another cell layout of the schematic shown in FIG. 6.

FIG. 8 is an alternative cell layout for the decoder cell shown in FIG. 6. With reference to both FIGS. 6 and 8, block 160 represents NAND gate circuitry 102 (shown individually in FIG. 6) and block 162 includes the circuitry of switch 106 and inverter 104 (shown individually in FIG. 6). Block 164 is the N-channel transistor active region which includes N-channel transistors 112. Block 166 is the P-channel transistor active region which includes P-channel transistors 114 (such as transistors 110 in FIG. 6). Block 168 is the N-well region that accompanies P-channel region 166. Data bits a, b, c, d, e and f and complemented data bits a, b, c, d, e and f are bused into the cell through bus lines 170, for example polysilicon lines. Thus, as seen in FIGS. 8 and 8C, the cell does not require contacts made to the bus lines. The present invention is not limited to the order of the data bus lines shown in FIG. 8. For example, the bus lines may be arranged so that a data bit and its complement are bused adjacent to each other. Alternatively, all data bits may be grouped as six bus lines and all complements grouped as six bus lines. Finally, other random orders may also be used.

Within the signal driver circuit, the cell shown in FIG. 8 will be repeated sixty-four times for each column output, substantially across the height of the chip. Thus, for example, bus lines 170 may extend substantially from the bottom to the top of signal driver 14. The cells may then be stacked above each other within the layout. Since bond pads for the output columns may be placed along the bottom of the chip and such bond pads require a user defined separation (80 microns in one embodiment), the width of each cell (direction w in FIG. 8) is predefined. Thus, in order to reduce the area of the cell, the height of each cell (direction h in FIG. 8) must be reduced. Therefore, according to the present invention a cell design emphasizing height reduction has been provided.

Bus lines 170 are polysilicon lines that also function as the gates for N-channel transistors 112 and P-channel transistors 114. While using polysilicon as bus lines raises the bus line resistance compared to metal bus lines, this characteristic does not impact the cell severely because the signals on bus lines 170 are changing slowly. The layout of N-channel transistors 112 and P-channel transistors 114 as shown in FIG. 8 results in a circuit that may be illustrated as in FIG. 8A. Thus, N-channel transistors 112 are laid out as a strand of abutting transistors that have shared active areas (or source drain areas) between ground 172 and NAND gate output 174. However when programmed, of the twelve transistors 112 only the six transistors that correspond to the six-bit number the decoder cell is programmed to decode will be left connected in series between ground 172 and NAND gate output 174. Likewise, P-channel transistors 114 are laid out as a strand of abutting transistors that have shared active areas. However when programmed, of the twelve transistors 114 only the six transistors that correspond to the six-bit number the decoder cell is programmed to decode will be connected in parallel between $V_{DDD}$ and the NAND gate output.

Figure 8A:
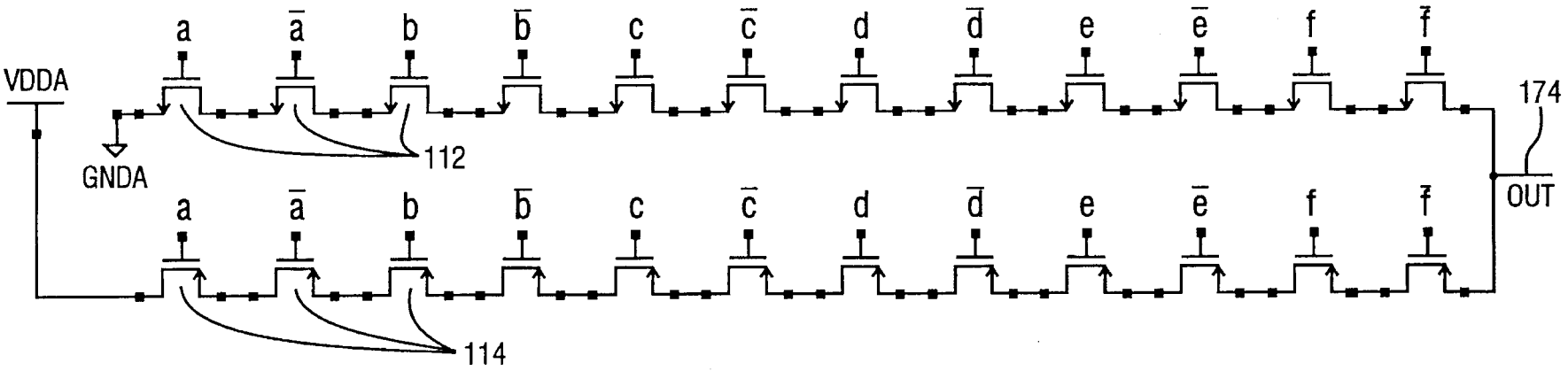
FIG. 8A is an electrical schematic of a portion of the cell layout of FIG. 8.
Figure 8B:
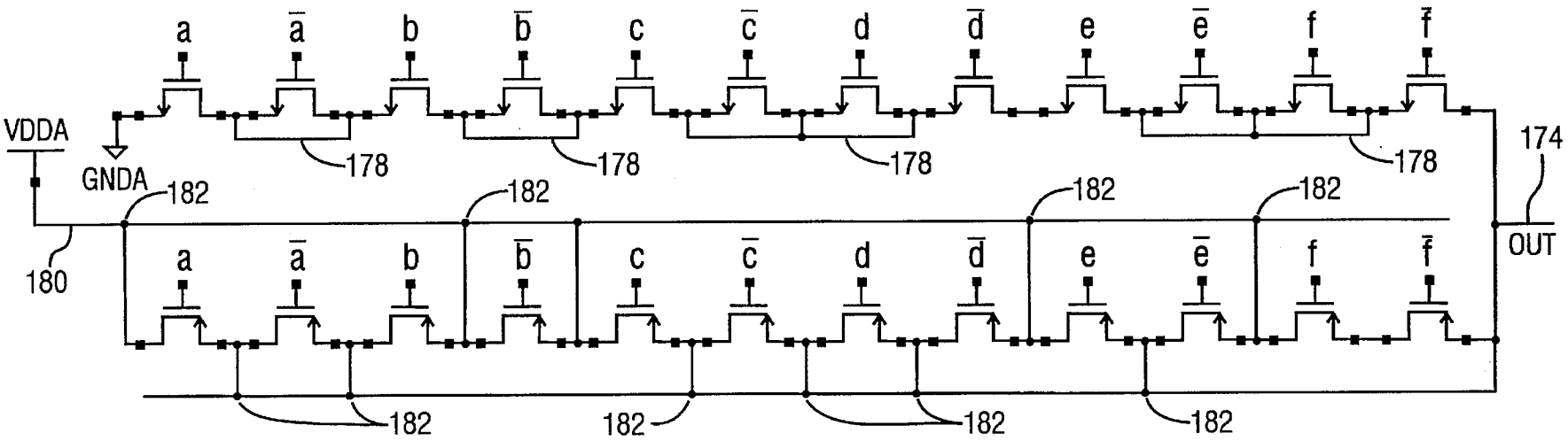
FIG. 8B is an electrical schematic illustrating the programmability of the schematic shown in FIG. 8A.
Figure 8C:
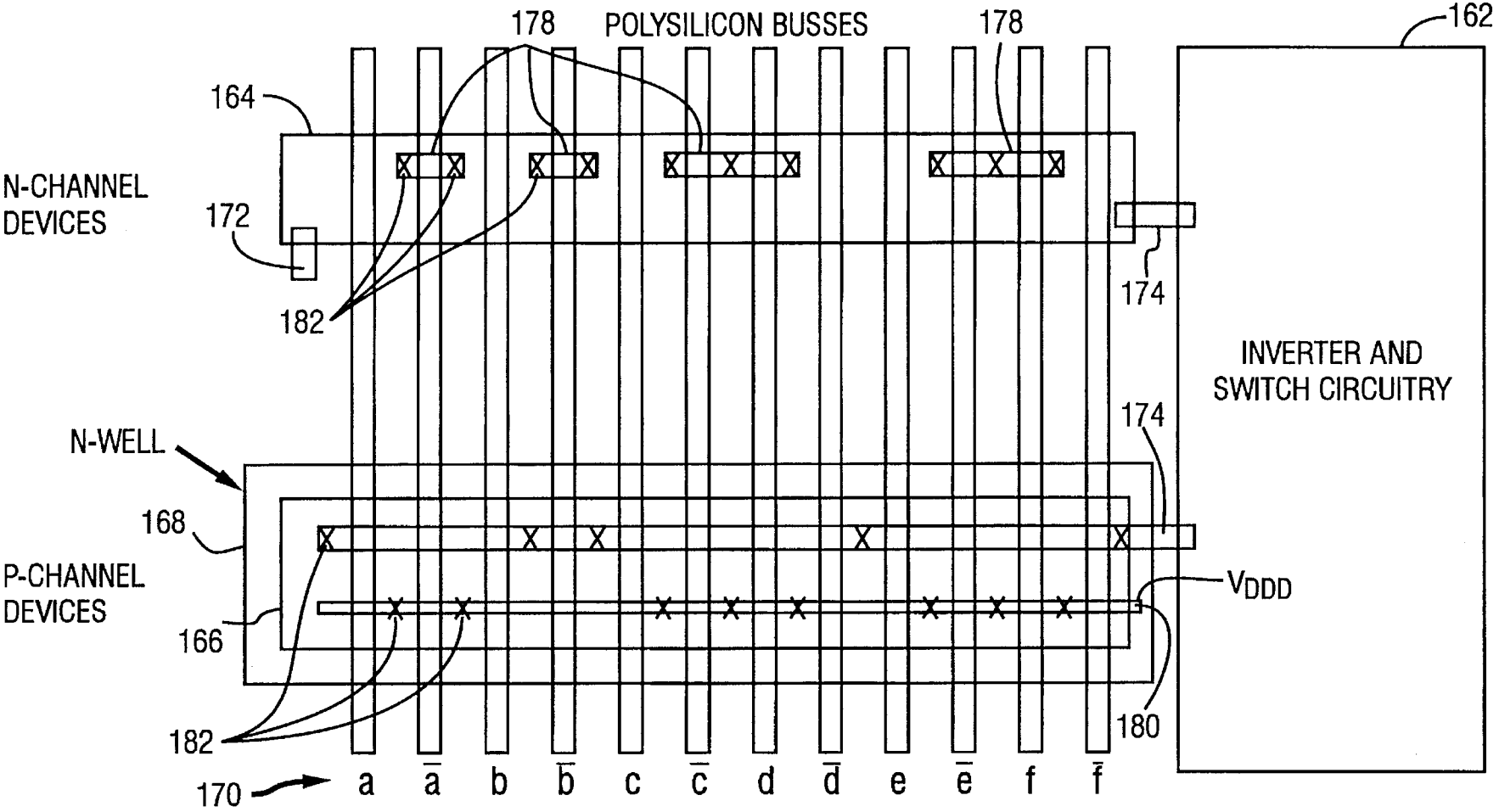
FIG. 8C shown a programmed cell of the cell layout shown in FIG. 8.

The method of programming the circuit shown in FIGS. 8 and 8A may be seen more clearly with reference to FIGS. 8B and 8C. Transistors 112 that are not used for the series transistors for a particular decode state are shorted out. Unused transistors 112 are shorted by contacting a metal strap 178 between the transistor source and drain. For example as shown in FIGS. 8B and 8C, the cell is programmed to decode the six-bit numbers a, b, c, d complement, e and f complement, thus metal straps 178 and contacts 182 are placed between the source and drain of the transistors which have as gates polysilicon bus lines a complement, b complement, c complement, e, e complement and f.

P-channel transistors 114 that are used for the particular decode state are connected in parallel between $VDD_D$ line 180 and NAND output line 174. Six P-channel transistors 114 are connected in parallel to correspond to the six-bit number the decoder cell is programmed to decode. The desired P-channel transistors are selected by placing contacts 182 at the source and drain locations required to connect those transistors in parallel between $V_{DDD}$ and NAND output. The remaining P-channel transistors that are not used for the particular decode state are shorted out to either $V_{DDD}$ line 180 or NAND output line 174 through the placement of contacts 182. Thus, as shown in FIG. 8B and 8C, P-channel transistors 114 that correspond to the six-bit decode state A, B, C, D complement, E and F complement are connected in parallel between $VDD_D$ line 180 and NAND output line 174. Meanwhile, P-channel transistors corresponding to a complement, c complement, d, e complement and f are shorted to $V_{DDD}$ line 180 and the P-channel transistor corresponding to b complement is shorted to NAND output line 174. In general, P-channel transistors are shorted to line 174 or 180 such that the desired transistors are placed in parallel while the unwanted transistors are shorted.

As shown in FIG. 6, each decoder cell includes a parallel P-channel and series N-channel NAND gate input structure and an inverter that has both P-channel and N-channel devices. However according to the present invention, it is possible to utilize a NAND gate structure that utilizes input transistors that are all the same conductivity type. Utilizing a single conductivity type transistor for both the series and parallel input transistor strands provides significant reduction in the cell area because circuit layout design rule requirements between different conductivity types, such as design rule minimum distances between N-well and N-channel devices, may be alleviated between the series and parallel input transistors. This results in considerable cell area shrinkage (particularly in cell height) for cells arranged such as in FIG. 8. Moreover, only using N-channel transistors as the NAND gate inputs lowers the input capacitance of the NAND gate because generally P-channel transistors must be sized larger than N-channel transistors to achieve the same drive strength, thus, resulting in more capacitance (and power dissipation) when using P-channel transistors in the NAND gate inputs.

Figure 9:
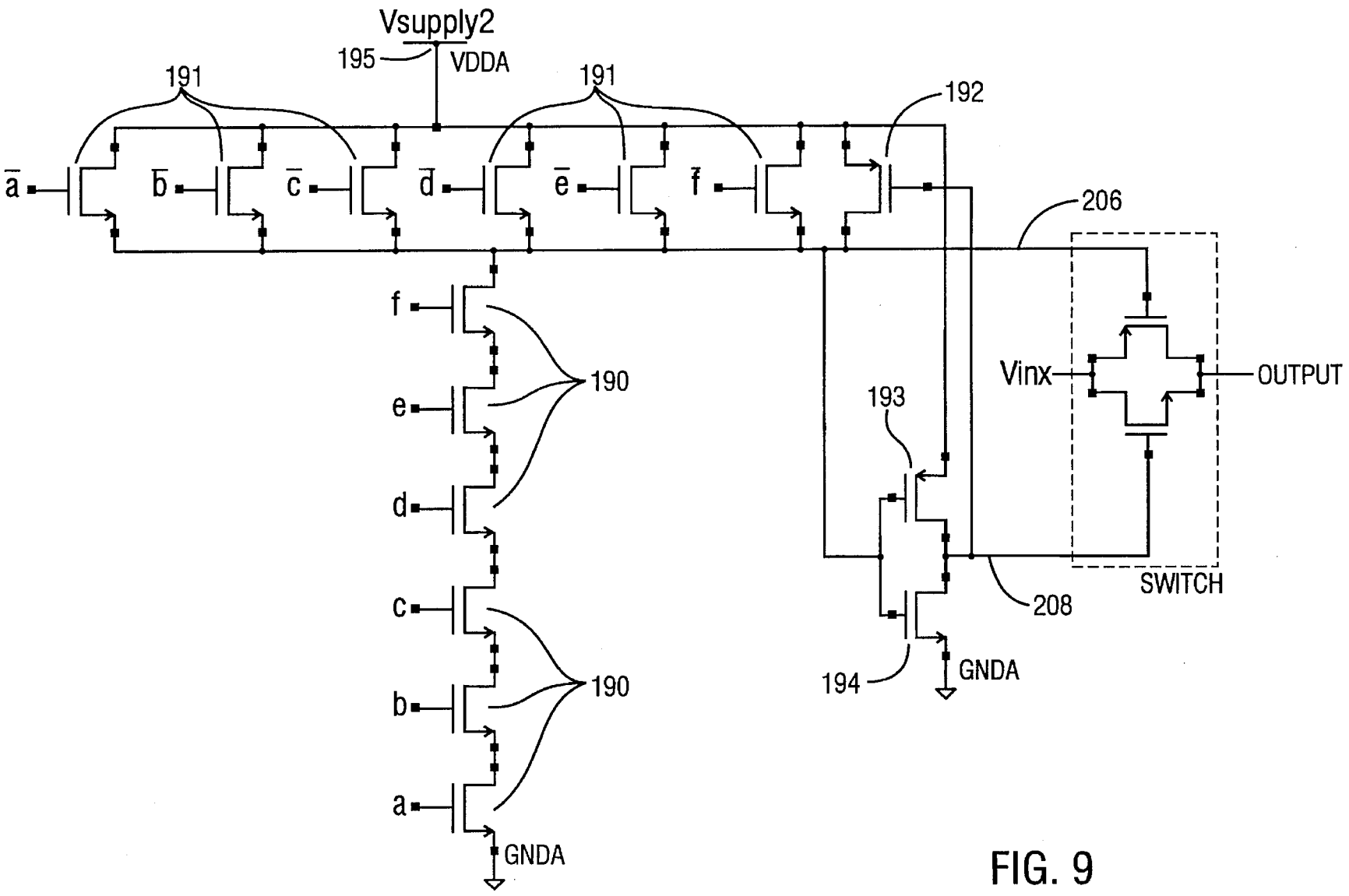
FIG. 9 is an embodiment of the electrical schematic of a decoder cell and associated circuitry of the present invention.

One such circuit using same conductivity NAND gate inputs is shown in FIG. 9. In FIG. 9, parallel input transistors 190 and series input transistors 191 are all N-channel transistors. In this arrangement, series transistors 190 receive the data corresponding to the decode state the cell is programmed to decode while parallel transistors 191 receive the complements of the data corresponding to the decode state the cell is programmed to decode. Thus, as shown in FIG. 9, the cell is programmed to small decode state a, b, c, d, e, and f. Transistors 192, 193 and 194 operate to provide an output and output complement with no static current drawn by the cell.

Figure 9A:
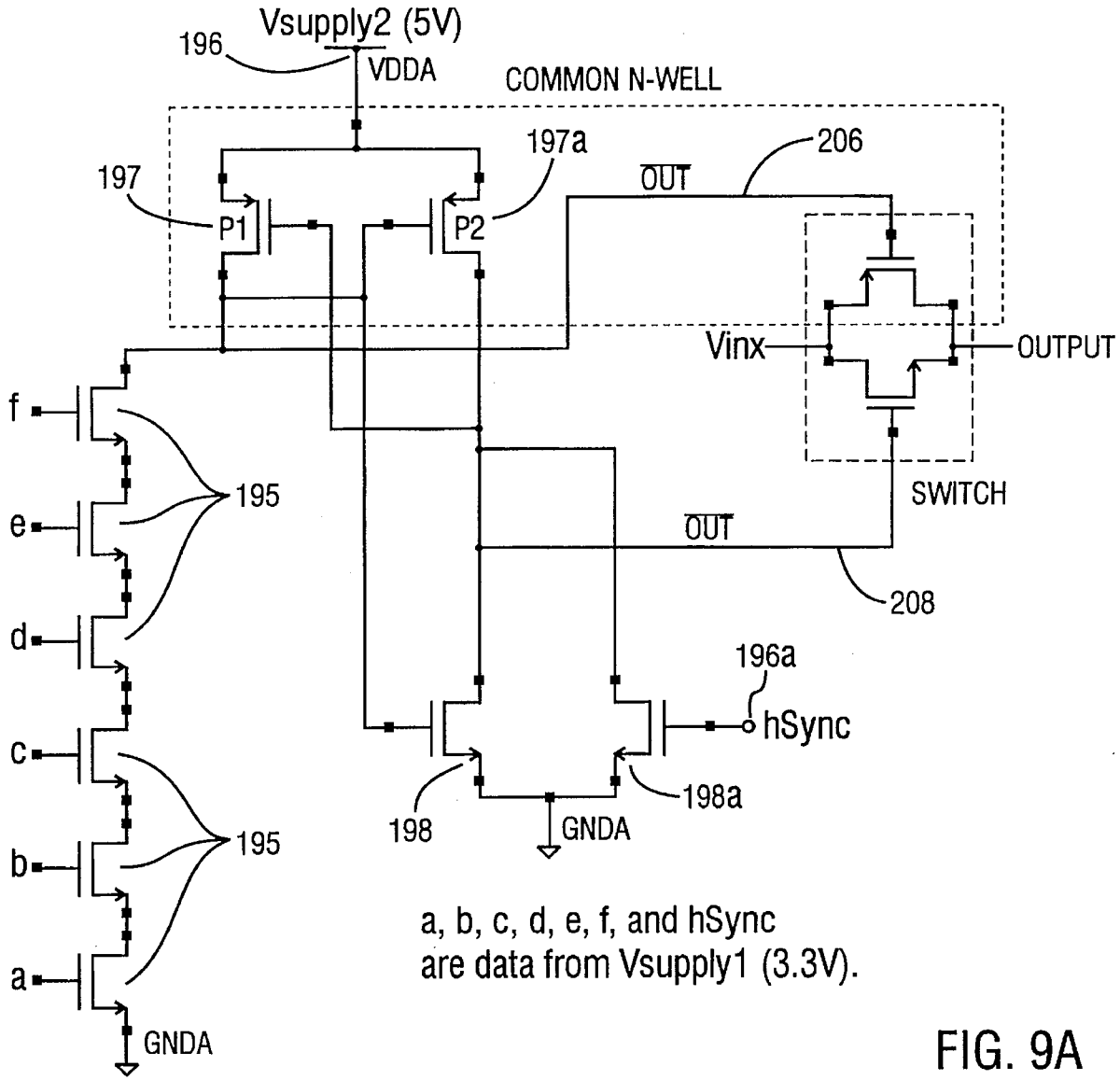
FIG. 9A is another embodiment of the electrical schematic of a decoder and associated circuitry of the present invention.

Another circuit using only N-channel transistors as inputs for the data bits is shown in FIG. 9A. This circuit utilizes series transistors 195 to receive data bits a, b, c, d, e, and f (the desired decode state shown) coupled to devices 197, 197*a*, 198 and 198*a* to perform a latch type function of the decode states. The circuit in FIG. 9A does not require the parallel transistor strand, rather transistors 197, 197*a*, 198, and 198*a* complete the NAND/latch function and provide an output 206 and output complement 208. Node 196*a* provides a reset node which may be tied, for example, to HSYNC. As an alternative to the circuit shown in FIG. 9A, the series transistor strand of FIG. 9 may be deleted while the parallel transistor strand retained.

Figure 9B:
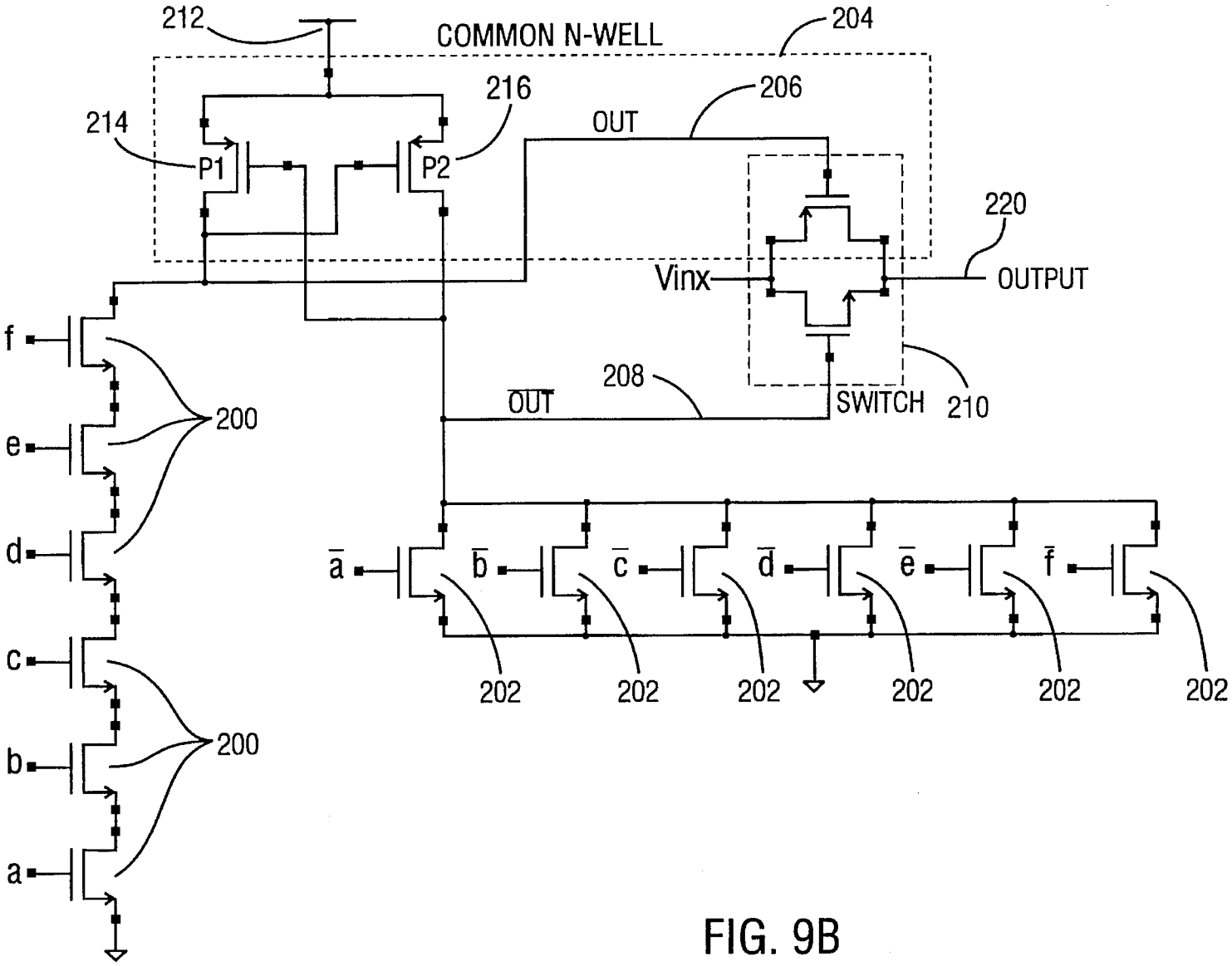
FIG. 9B is yet another electrical schematic of an embodiment of the decoder and associated circuitry according to the present invention.

FIG. 9B shows yet another circuit utilizing the same conductivity type transistor as the data input transistors for the NAND gate. The circuit in FIG. 9B has a combination of series N-channel transistors 200 and parallel N-channel transistors 202. The series N-channel transistors 200 are each gated to the a-f data bit lines while transistors 202 are gated to the a complement-f complement data lines. This cell may also be laid out using bussed polysilicon conductors where depending on the six-bit number the decoder cell is programmed to decode, the source and drains of appropriate series N-channel transistors 200 will be shorted out, for example with metal straps, and the appropriate parallel N-channel transistors 202 will not be connected such as shown with reference to FIG. 8B and 8C. As may be seen in FIG. 9, 9A and 9B, the cells used in these embodiments require only three P-channel devices that may be conveniently placed in the same N-well 204. These circuits also provide a NAND signal 206 and inverted NAND signal 208 for use by switch 210.

As noted above, it is desirable to operate the signal driver circuit at a low supply voltage such as 3.3 volts or lower. However, in order to allow the switches to provide an analog voltage of up to 5 volts, the circuit voltage levels must be shifted upward. The circuits shown in FIGS. 9, 9A and 9B provide a convenient method of shifting the voltage level within the decoder cell without requiring additional level shifting circuitry elsewhere. Furthermore, the decoder cells shown allow level shifting by bringing a node to a higher voltage. Thus, even within the cell additional level shifter circuitry is minimized and is cell area conserved. In FIG. 9, level shifting may be accomplished by providing a higher operating voltage at node 195. Similarly, in FIG. 9A a higher operating voltage may be provided at node 196. In FIG. 9B, the level shifting is performed by providing a higher voltage at node 212 to operate the two P-channel devices 214 and 216 that are merged into the output of the decoder cell. Since these two P-channel devices are not connected to the data lines, they may be located in the same N-well that contains the P-channel half of the switch. Similarly, this may be done for the circuits in FIGS. 9 and 9A.

It will be recognized that the circuits shown in FIGS. 9, 9A and 9B do not require level shifting. A user may utilize these circuits without level shifting by providing the standard supply voltage to nodes 195, 196 and 212 (for FIGS. 9, 9A and 9B, respectively). Thus, a user selectable level shifting circuit is provided and if a user desires to utilize only one supply voltage, the circuit is still functional and other aspects of the present invention are still applicable.

Level shifting will be described more particularly with reference to FIG. 9B. The FIG. 9B circuit may be used as a level shifting circuit if supply voltage ($V_{supply\text{-}2}$) for node 212 for P-channel transistors 214 and 216 is a higher voltage (for example, 5 volts) than the supply voltage for the data bit and complement data bit lines (for example, 3.3 volts). In a typical design, P-channel transistors 214 and 216 are sized to be weak pull-up devices so that the N-channel devices may overcome the P-channel transistors to enable the circuit to change states. When the parallel N-channel transistors 202 are all turned off, then the series N-channel transistors 200 are all turned on, and output line 206 is pulled low. Pulling output line 206 low then turns on transistor 216 and this in turn pulls output complement line 208 up to $V_{supply\ 2}$ at node 212 thus turning off transistor 214. The opposite occurs when the series transistors 201 are turned off and the parallel transistors 202 are turned on. Thus, no static current flows in either condition.

Therefore, though the data bits and their complements are data from $V_{supply\ 1}$ at 3.3 volts, if $V_{supply\ 2}$ at 5 volts is connected to node 212, then the NAND gate output and the inverted NAND gate output 206 and 208, respectively, will now be 5 volt outputs. Thus, switch 210 may operate to supply analog voltage output 220 that may range as high as approximately 5 volts. The present invention is not limited, though, to 3.3 volts and 5 volts, and other voltages and amounts of level shifting may be used and the level shifting may be either up or down.

The decoder circuits of FIG. 9 and 9B function such that if the one unique decode state that a cell is programmed to decode is on the inputs to a cell, then all the series N-channel devices are turned on and all the parallel N-channel devices are turned off. Thus, the data bits that correspond to the unique decode state a cell is programmed to decode are provided to the series transistor gates while the complement data bits are provided to the parallel transistor gates. As seen in FIGS. 9 and 9B, the cells are programmed to decode the state a, b, c, d, e and f. With specific reference to FIG. 9B, a decoding cell pulls NAND output line 206 to ground and NAND output complement line 208 to 5 volts, causing switch 210 to be turned on. Likewise, if the particular decode state the cell is programmed to decode is not present on the inputs to a cell, one or more of the series devices will be turned off and one or more of the parallel devices will be turned on. This pulls output line 206 up to 5 volts and output complement line 208 to ground causing the switch to be turned off.

Figure 10:
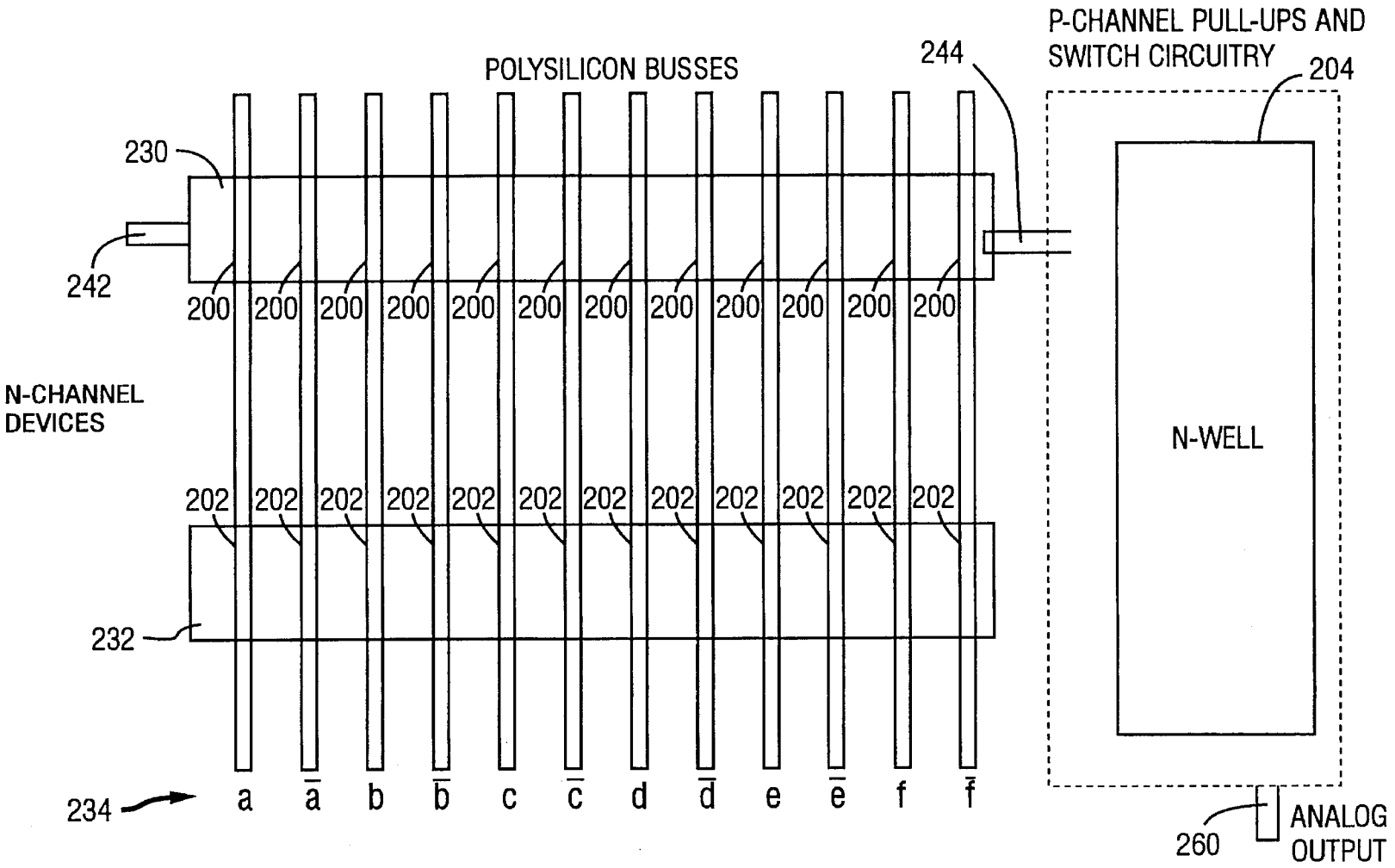
FIG. 10 is a cell layout of the electrical schematic shown in FIG. 9B.

A cell layout for the circuits shown in FIG. 9B is shown in FIG. 10. In FIG. 10, N-channel region 230 is provided for the plurality of series N-channel transistors 200 and N-channel region 232 is provided for the plurality of parallel N-channel transistors 202. Similar to the cell in FIGS. 8 and 8C, in FIG. 10 data bits and inverse data bits are bused into each cell through polysilicon buses 234. Once again, the present invention is not limited to the specific order of the data bits in buses 234 that is shown in the figures.

Figure 10A:
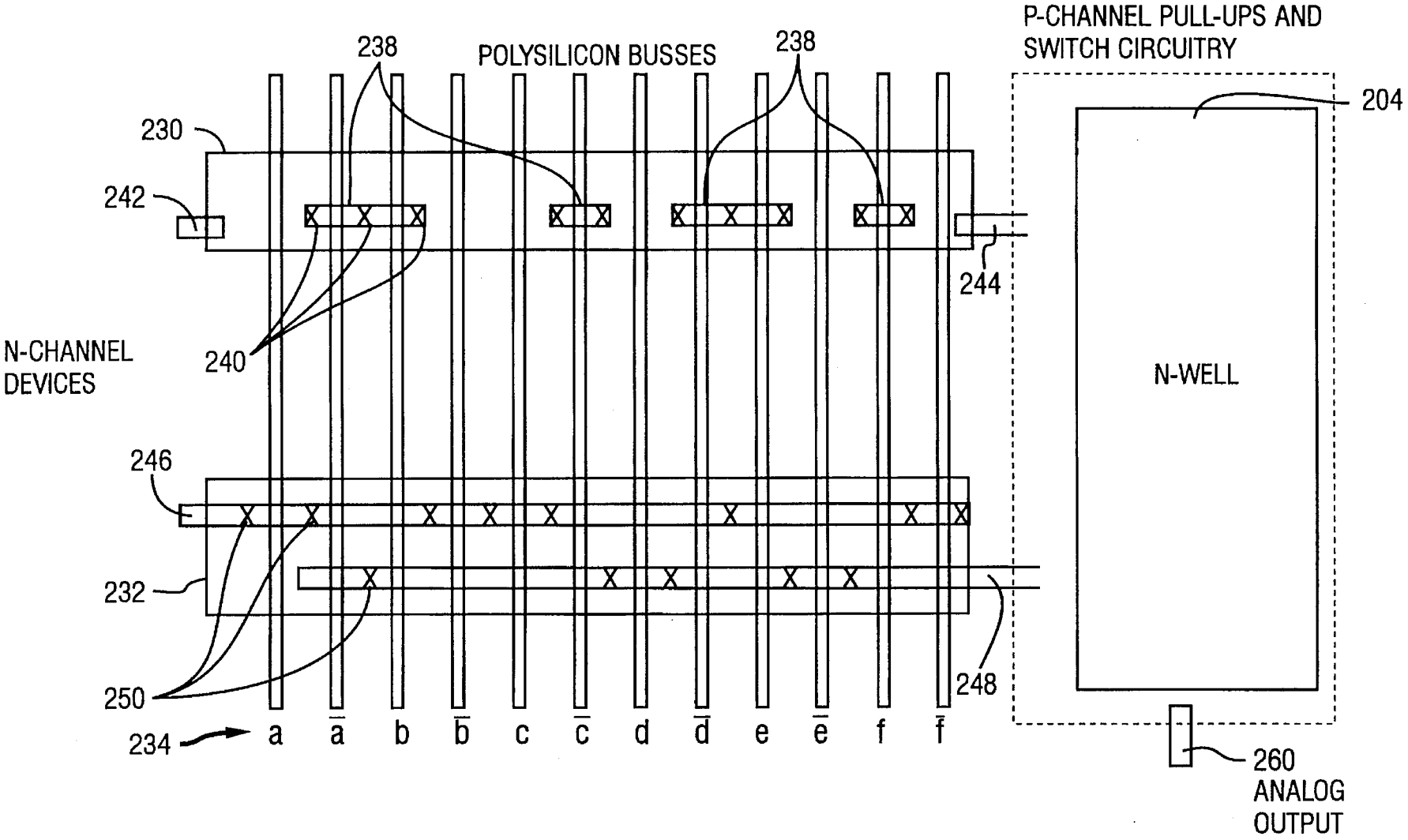
FIG. 10A shows a programmed cell of the cell layout shown in FIG. 10.

The programming of the cell shown in FIG. 10 is accomplished similar to the programming method described with reference to FIGS. 8, 8A, 8B, and 8C. Thus, depending on the particular six-bit number that the cell is programmed to decode, metal straps are provided to short out the source and drain of unwanted transistors in the N-channel series transistor string. For example, as shown in FIG. 10A, metal straps 238 and source drain contacts 240 are provided such that only the transistors corresponding to data bits a, b complement, c, d, e complement and f complement are placed in series between ground 242 and NAND output signal 244.

Likewise, the appropriate parallel N-channel transistors within N-channel region 232 are programmed to decode the inverse of the six-bit number that corresponds to the unique decode state that the cell is programmed to decode. Thus, the proper transistors are programmed to be connected in parallel between ground line 246 and NAND inverted output 248, while the remaining transistors are shorted out to ground line 246 or NAND inverted output 248. For example as shown in FIG. 10, the transistors corresponding to data bits a complement, b, c complement, d complement, e, and f are connected in parallel since the cell is programmed to decode the state a, b complement, c, d, e complement and f complement. This programming of the parallel transistors may be made by placing appropriate source drain contacts along ground line 246 and NAND inverted output line 248. Lines 246 and 248 are preferably metal. Thus, as shown in FIG. 10, contacts 250 are used to connect in parallel the transistors corresponding to data lines a complement, b, c complement, d complement, e and f while shorting the remaining transistors 200 to either lines 246 or 248.

In order to conserve cell area, the P-channel pull-up transistors 214 and 216, and the P-channel transistor within switch 210, may all be placed within N-well 204. The output of switch 210 is output line 260. Output line 260 is the analog output that is provided to an LCD column.

Figure 11:
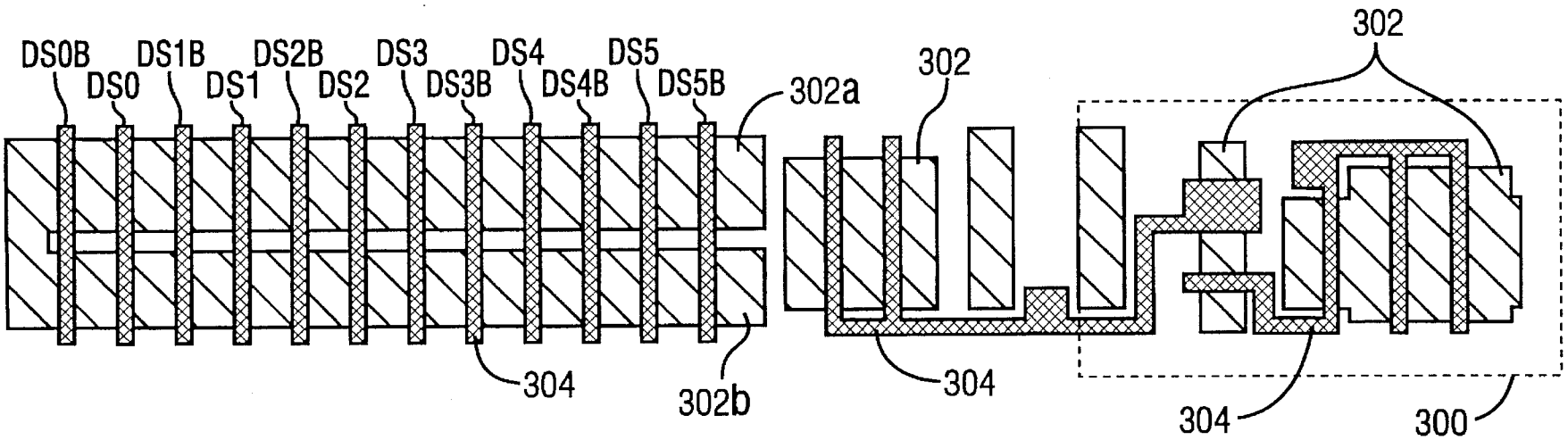
FIG. 11 shows the N-well, source drain (or active area) and polysilicon masking layers of the cell layout shown in FIG. 10.
Figure 12:
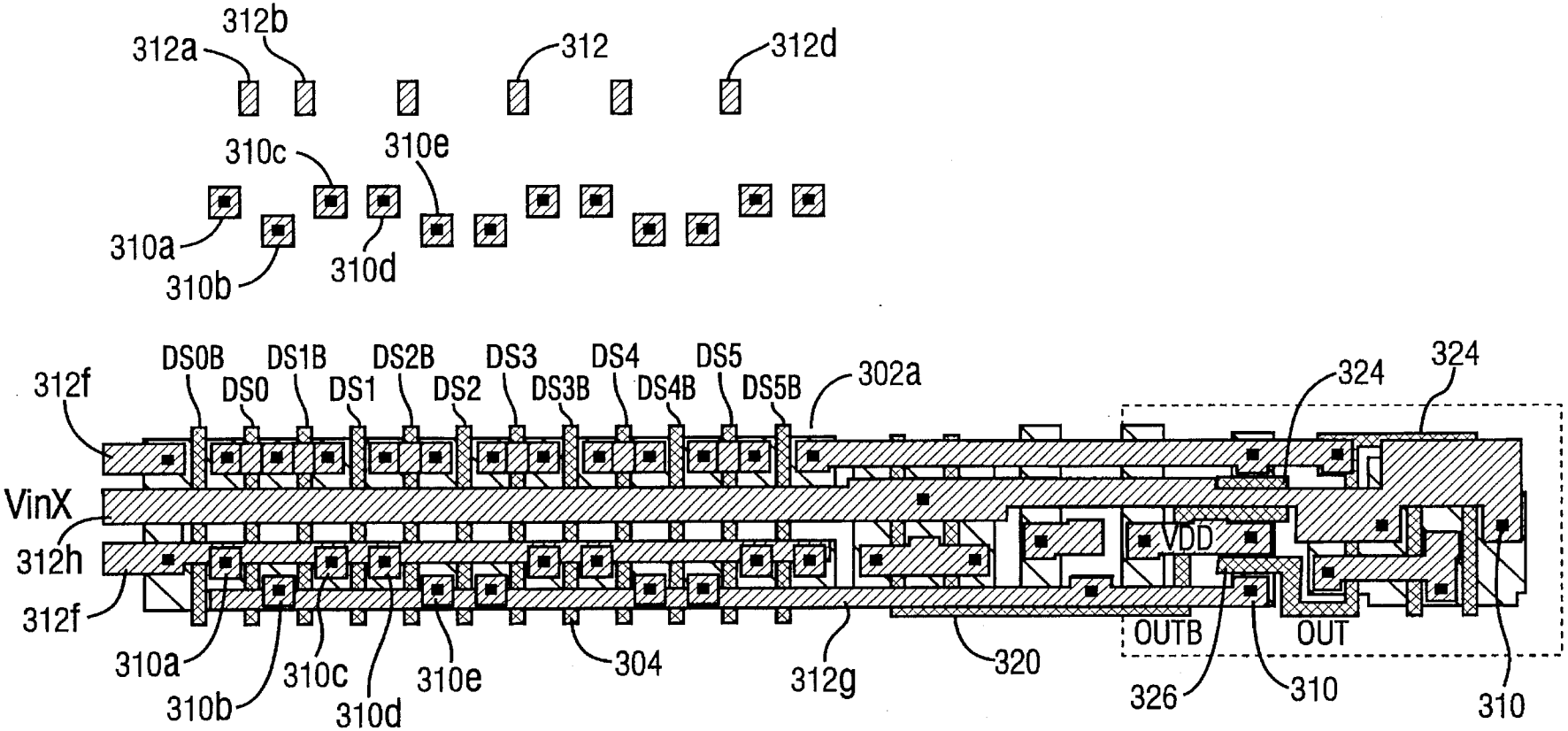
FIG. 12 shows the addition of contact and metal 1 masking layers to the masking layers shown in FIG. 11.
Figure 13:
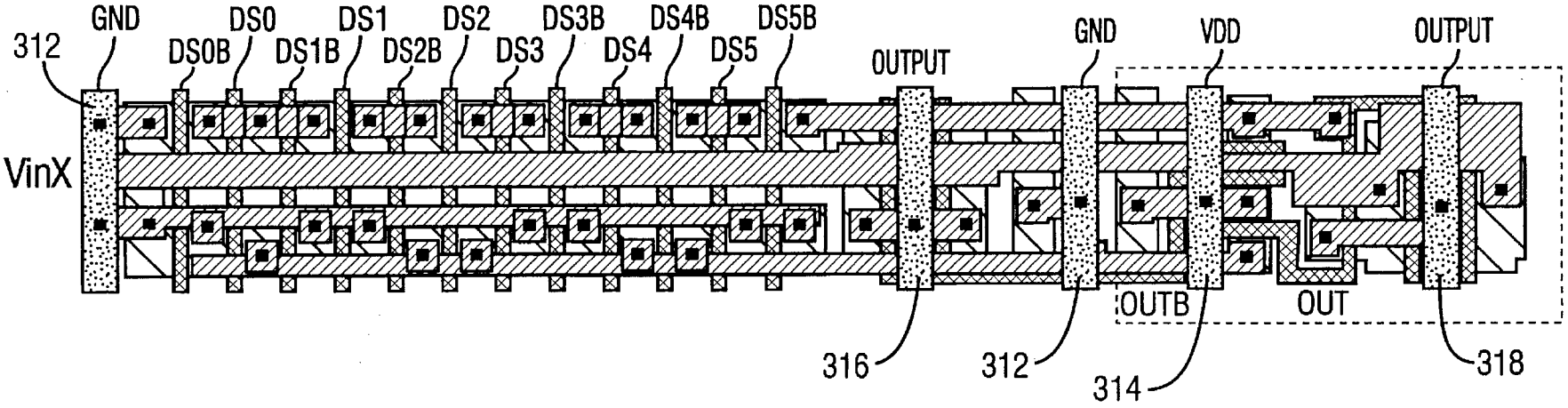
FIG. 13 shows the addition of the via and metal 2 masking layers to the masking layers shown in FIG. 12.

An embodiment of the semiconductor cell layout of the circuit shown in FIG. 9B is shown with more detail in FIGS. 11—13. In FIGS. 11—13, various layers of the cell layout are progressively shown. In FIG. 11, block 300 represents an N-well region. Regions 302 represent active areas (P type source/drains within the N-well and N type source/drains outside the N-well region). Polysilicon is represented by shaded regions 304. Data is bused into the cell via six polysilicon data lines, DS0-DSS, and six polysilicon complement data lines, DSOB–DSSB (where "B" indicates a complement data bit). Active region 302*a* represents the region where the serial N-channel transistors are formed and active region 302*b* represents the region where the parallel N-channel transistors are formed.

FIG. 12 is the same layout as FIG. 11 with the addition of the contacts 310 (squares) and metal one lines 312 (cross hatched). The contact layer and metal one layer may be used to program the cell. The programming contacts and metal have been shown both within and above the cell as referenced by 310*a*, 310*b*, 310*c*, etc. and 312*a*, 312*b*, 312*c*, etc. in order to more clearly show the programming of a particular decode state. It is understood that the contacts and metal straps shown above the cell are contained within the cell and are simply shown above the cell in the figure for illustrative purposes. As shown, the cell is programmed to decode data state DSOB, DS1, DS2, DS3B, DS4B, and DS5B. For example, metal strap 312*a* shorts series transistor DS0 and metal strap 312*b* shorts series transistor DS1B. Further, contacts 310*a* and 310*b* connect parallel transistor DS0 in parallel between ground 312*f* and $V_{DDD}$ 312*g*. Likewise, contacts 310*c* and 310*d* short parallel transistor DS1 to ground 312*f*. In a similar fashion the remaining programming can be seen from the figure. $V_{in}$ is also bused into the cell through conductor 312*h* (such as conductors 38 in FIGS. 3C and 3D). N-channel switch transistor 320, P-channel switch transistor 322 and two P-channel pull-up transistors 324 and 326 are also provided.

FIG. 13 is similar to FIG. 12, however, via and metal 2 layers are overlayed. Thus, the placement of metal 2 ground lines 312, $V_{DDD}$ lines 314 and analog output line 316 and 318 are shown. Output lines 316 and 318 may be tied together outside the cells, such as at one end of a column of cells.

Further modifications and alternative embodiments of this invention will be apparent to those skilled in the art in view of this description. For example, the N-channel and P-channel devices shown herein are generally the preferred arrangement of device types. However, it will be recognized that conceptually the circuitry of the present invention will operate if all N-channel transistors are replaced with P-channel transistors and all P-channels transistors are replaced with N-channel transistors. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the shape, size and arrangement and types of components or devices. For example, equivalent elements or materials may be substituted for those illustrated and described herein, and certain features of the invention may be utilized independently of the use of other features, all as would be apparent to one skilled in the art after having the benefit of this description of the invention.

What is claimed is:

1. A signal driving integrated circuit chip for driving an LCD panel, comprising:

a plurality of decoding cells for selecting voltages for outputs of said signal driving circuit;

a resistor voltage divider comprising, a first resistor series comprising a first plurality of resistors connected in series, a second resistor series comprising a second plurality of resistors connected in series, at least one of said first plurality of resistors being operatively connected in parallel with at least one of said second plurality of resistors to form a parallel connected resistor, at least a portion of said plurality of decoding cells being physically located between said first resistor series and said second resistor series, at least two resistor voltage inputs connected to at least two reference voltages, and at least two of said resistor voltage inputs shared by each of said first and second resistor series; and at least one conductor connected to an output of one of said parallel connected resistors and connected to at least one of said plurality of decoding cells.

2. The signal driving circuit of claim 1, wherein said plurality of decoding cells comprises a decoding cell positioned between said first resistor series and said second resistor series, wherein said first resistor series comprises a first resistor electrically connected to said decoding cell, and said second resistor series comprises a second resistor electrically connected to said decoding cell such that a distance between an output of said first resistor and said decoding cell is approximately equal to a distance between an output of said second resistor and said decoding cell.

3. The signal driving circuit of claim 1, wherein said plurality of decoding cells comprises a decoding cell positioned between said first resistor series and said second resistor series, wherein said first resistor series comprises a first resistor electrically connected to said decoding cell, and second resistor series comprises a second resistor electrically connected to said decoding cell such that an electrical resistance between an output of said first resistor aM said decoding cell is approximately equal to an electrical resistance between an output of said second resistor and said decoding cell.

4. The signal driving circuit of claim 1, wherein said one of said plurality of decoding cells is positioned approximately symmetrically around a midline of said circuit.

5. The signal driving circuit of claim 1, further comprising:

a plurality of reference voltage bond pads comprising:

a first reference voltage bond pad corresponding to both a first reference voltage node in said first resistor series and a first reference voltage node in said second resistor series, wherein said first reference voltage bond pad, said second reference voltage bond pad, said first resistor series, and said second resistor series are located such that a distance between said first reference voltage bond pad and said first reference voltage node in said first resistor series is approximately equal to a distance between said first reference voltage bond pad and said first reference voltage node in said second resistor series.

6. The signal driving circuit of claim 1, further comprising:

a plurality of reference voltage bond pads comprising:

a first reference voltage bond pad corresponding to both a first reference voltage node in said first resistor series and a first reference voltage node in said second resistor series, wherein said first reference voltage bond pad, said second reference voltage bond pad, said first resistor series, and said second resistor series are located, such that an electrical resistance between said first reference voltage bond pad and said first reference voltage node in said first resistor series is approximately equal to an electrical resistance between said first reference voltage bond pad and said first reference voltage node in said second resistor series.

7. The signal driving circuit of claim 1, wherein said plurality of decoding cells comprises a decoding cell positioned between said first resistor series and said second resistor series, wherein said first resistor series comprises a first resistor electrically connected to said decoding cell, and said second resistor series comprises a second resistor electrically connected to said decoding cell such that a distance between an output of said first resistor and said decoding cell is approximately equal to a distance between an output of said second resistor and said decoding cell.

8. The signal driving circuit of claim 1, wherein said plurality of decoding cells comprises a decoding cell positioned between said first resistor series and said second resistor series, wherein said first resistor series comprises a first resistor electrically connected to said decoding cell, and second resistor series comprises a second resistor electrically connected to said decoding cell such that an electrical resistance between an output of said first resistor and said decoding cell is approximately equal to an electrical resistance between an output of said second resistor and said decoding cell.

9. The signal driving circuit of claim 1, wherein said one of said plurality of decoding cells is positioned approximately symmetrically around a midline of said circuit.

10. The signal driving circuit of claim 1, further comprising:

a plurality of reference voltage bond pads comprising:

a first reference voltage bond pad corresponding to both a first reference voltage node in said first resistor series and a first reference voltage node in said second resistor series, wherein said first reference voltage bond pad, said second reference voltage bond pad, said first resistor series, and said second resistor series are located such that a distance between said first reference voltage bond pad and said first reference voltage node in said first resistor series is approximately equal to a distance between said first reference voltage bond pad and said first reference voltage node in said second resistor series.

11. The signal driving circuit of claim 1, further comprising:

a plurality of reference voltage bond pads comprising:

a first reference voltage bond pad corresponding to both a first reference voltage node in said first resistor series and a first reference voltage node in said second resistor series, wherein said first reference voltage bond pad, said second reference voltage bond pad, said first resistor series, and said second resistor series are located such that an electrical resistance between said first reference voltage bond pad and said first reference voltage node in said first resistor series is approximately equal to an electrical resistance between said first reference voltage bond pad and said first reference voltage node in said second resistor series.

12. A signal driving integrated circuit chip for providing a plurality of voltage levels to an LCD panel, comprising:

a plurality of decoding cells spaced across said circuit; and a plurality of resistor voltage dividers adapted to provide voltages to said plurality of decoding cells, said plurality of resistor voltage dividers being formed at a plurality of physical locations within said integrated circuit, at least a portion of said plurality of decoding cells being physically positioned between said plurality of locations.

13. The signal driving circuit of claim 12, wherein a distance between adjacent said locations is approximately 1/n times a length of said circuit, n being a number of said locations.

14. The signal driving circuit of claim 12, said plurality of resistor voltage dividers comprising:

a first resistor voltage divider formed at a first location of said circuit;

a second resistor voltage divider, formed at a second location of said circuit, a distance between said first location and a first edge of said circuit being approximately equal to a distance between said second location and a second edge of said circuit.

15. The signal driving circuit of claim 12, further comprising:

a plurality of reference voltage bond pads placed along a first side of said circuit;

each of said voltage dividers having a first end and a second end, both ends terminating proximate said first side.

16. The signal driving circuit of claim 12, wherein said plurality of resistor voltage dividers comprises a first voltage divider and a second voltage divider, said signal driving circuit further comprising:

a plurality of reference voltage bond pads comprising:

a first reference voltage bond pad corresponding to both a first reference voltage node in said first voltage divider and a first reference voltage node in said second voltage divider, wherein said first reference voltage bond pad, said second reference voltage bond pad, said first voltage divider, and said second voltage divider are located such that a distance between said first reference voltage bond pad and said first reference voltage node in said first voltage divider is approximately equal to a distance between said first reference voltage bond pad and said first reference voltage node in said second voltage divider.

17. The signal driving circuit of claim 12, wherein said plurality of resistor voltage dividers comprises a first voltage divider and a second voltage divider, said signal driving circuit further comprising:

a plurality of reference voltage bond pads comprising:

a first reference voltage bond pad corresponding to both a first reference voltage node in said first voltage divider and a first reference voltage node in said second voltage divider, wherein said first reference voltage bond pad, said second reference voltage bond pad, said first voltage divider, and said second voltage divider are located such that a distance between said first reference voltage bond pad and said first reference voltage node in said first voltage divider is approximately equal to a distance between said first reference voltage bond pad and said first reference voltage node in said second voltage divider.

18. The signal driving circuit of claim 15, further comprising:

a first-end reference voltage bond pad to which said first end of each of said voltage dividers is connected, and a second-end reference voltage bond pad to which said second end of each of said voltage dividers is connected;

wherein said first-end reference voltage bond pad, said second-end reference voltage bond pad, and said voltage dividers are located such that:

distances between said first-end reference voltage bond pad and said first end of each of said voltage dividers are approximately equal; and distances between said second-end reference voltage bond pad and said second end of each of said voltage dividers are approximately equal.

19. The signal driving circuit of claim 15, further comprising:

a first-end reference voltage bond pad to which said first end of each of said voltage dividers is connected, and a second-end reference voltage bond pad to which said second end of each of said voltage dividers is connected;

wherein said first-end reference voltage bond pad, said second-end reference voltage bond pad, and said voltage dividers are located such that:

electrical resistances between said first-end reference voltage bond pad and said first end of each of said voltage dividers are approximately equal; and electrical resistances between said second-end reference voltage bond pad and said second end of each of said voltage dividers are approximately equal.

20. The signal driving circuit of claim 15, wherein said voltage dividers are approximately U-shaped.

21. The signal driving circuit of claims 15, wherein said plurality of reference voltage pads are positioned approximately symmetrically around a midline of said circuit.

22. A method of providing a plurality of voltage levels at the outputs of a signal driving integrated circuit chip, said integrated circuit operable to drive an LCD panel, said method comprising the steps of:

applying a reference voltage to a node in each of a plurality of voltage dividers, said plurality of voltage dividers comprising at least a first voltage divider comprising a first plurality of resistors and a second voltage divider comprising a second plurality of resistors:

operatively parallel connecting one of said first plurality of resistors to one of said second plurality of resistors, forming a parallel connected resistor;

decoding digital input data and selecting said plurality of voltage levels using a plurality of decoder cells and laying out, on said integrated circuit chip, at least one of said plurality of decoder cells at locations between said first voltage divider and said second voltage divider.

23. A method of providing a plurality of voltage levels at the outputs of a signal driving integrated circuit chip, said integrated circuit operable to drive an LCD panel, said method comprising the steps of:

applying a reference voltage to a node in each of a plurality of voltage dividers, said plurality of voltage dividers comprising at least a first voltage divider comprising a first plurality of resistors and a second voltage divider comprising a second plurality of resistors;

operatively parallel connecting of said of said first plurality of resistors to one of said second plurality of resistors, forming a parallel connected resistor; and decoding digital input data and selecting said plurality of voltage levels using a plurality of cells, wherein at least a 5portion of said plurality of cells is physically positioned between said first voltage divider and said second voltage divider, and wherein said portion of said plurality of cells is positioned so that a distance between said portion of said plurality of cells and said first voltage divider is approximately equal to a distance between said portion of said plurality of cells and said second voltage divider.

24. A method of providing a plurality of voltage levels at the outputs of a signal driving integrated circuit chip, said integrated circuit operable to drive an LCD panel, said method comprising the steps of:

applying a reference voltage to a node in each of a plurality of voltage dividers, said plurality of voltage dividers comprising at least a first voltage divider comprising a first plurality of resistors and a second voltage divider comprising a second plurality of resistors;

operatively parallel connecting one of said first plurality of resistors to one of said second plurality of resistors, forming a parallel connected resistor: and decoding digital input data and selecting said plurality of voltage levels using a plurality of cells, wherein at least a portion of said plurality of cells is physically positioned between said first voltage divider and said second voltage divider, and wherein said portion of said plurality of cells is positioned so that an electrical resistance between said portion of said plurality of cells and said first voltage divider is approximately equal to an electrical resistance between said portion of said plurality of cells and said second voltage divider.

25. The method of claim 24, wherein said plurality of voltage dividers are arranged in parallel locations on said circuit and a distance between two adjacent said parallel locations is approximately 1/n times the length of said circuit, n being a number of said parallel locations.

* * * * *

UNITED STATES PATENT AND TRADEMARK OFFICE

CERTIFICATE OF CORRECTION

PATENT NO. : 5,574,475
DATED : November 12, 1996
INVENTOR(S) : Callahan, Jr., et. al.

It is certified that error appears in the above-indentified patent and that said Letters Patent is hereby corrected as shown below:

In claim 3, column 18, line 21, delete "aM" and insert --and-- therefore.

In claim 23, column 22, line 4, after "connecting" insert --one--.

In claim 23, column 22, line 4, delete second occurrence of "of said".

In claim 23, column 22, line 9, delete "5portion" and insert --portion-- therefor.

Signed and Sealed this

Eighteenth Day of February, 1997

*Attest:*

Bruce Lehman

BRUCE LEHMAN

*Attesting Officer*

*Commissioner of Patents and Trademarks*